US006400095B1

(12) United States Patent
Primisser et al.

(10) Patent No.: US 6,400,095 B1
(45) Date of Patent: Jun. 4, 2002

(54) PROCESS AND DEVICE FOR THE DETECTION OF THE RECTIFIER EFFECT APPEARING IN A GAS DISCHARGE LAMP

(75) Inventors: Norbert Primisser, Fraxern; Reinhard Böckle, Mäder; Stefan Koch, Dornbirn, all of (AT); Stefan Rhyner, Niederurnen (CH)

(73) Assignee: Tridonic Bauelemente GmbH, Dornbirn (AT)

( * ) Notice: Subject to any disclaimer, the term of this patent is extended or adjusted under 35 U.S.C. 154(b) by 0 days.

(21) Appl. No.: 09/582,105

(22) PCT Filed: Nov. 19, 1998

(86) PCT No.: PCT/EP98/07428

§ 371 (c)(1),
(2), (4) Date: Jul. 13, 2000

(87) PCT Pub. No.: WO99/34647

PCT Pub. Date: Jul. 8, 1999
Prior Publication Data

PCT Pub. Date:

(30) Foreign Application Priority Data

Dec. 23, 1997 (DE) ..... 197 57 635
Jul. 1, 1998 (DE) ..... 198 29 434

(51) Int. Cl.[7] ..... H05B 37/02
(52) U.S. Cl. ..... 315/224; 315/121; 315/225

(58) Field of Search ..... 315/224, 225, 315/119, 121, DIG. 7

(56) References Cited

U.S. PATENT DOCUMENTS 5,636,111 A * 6/1997 Griffin et al. ..... 363/37

OTHER PUBLICATIONS

PCT International Preliminary Examination Report Jun. 16, 2000.*

* cited by examiner

*Primary Examiner*—David Vu
(74) *Attorney, Agent, or Firm*—Fitzpatrick, Cella, Harper & Scinto

(57) ABSTRACT

Process for the recognition of the rectifier effect appearing in a gas discharge lamp (G1, G2) and an electronic ballast, for the operation of gas discharge lamps (G1, G2), with which such a process finds employment. The electronic ballast includes a monitoring or control circuit (IC2) which monitors an operating parameter of a load circuit (E) of the electronic ballast, whereby this operating parameter corresponds to the lamp voltage or is dependent thereon. The monitoring circuit (IC2) integrates this monitored operating parameter over a full period and determines upon the presence of a rectifier effect if the integration result deviates from a predetermined integration desired value. Further, for the recognition of the rectifier effect, the duration of the positive and negative half-waves of the monitored parameter can be compared.

32 Claims, 11 Drawing Sheets

STATE OF THE ART

PROCESS AND DEVICE FOR THE DETECTION OF THE RECTIFIER EFFECT APPEARING IN A GAS DISCHARGE LAMP

BACKGROUND OF THE INVENTION

1. Field of the Invention

The present invention relates to a process for the detection of the rectifier effect appearing in a gas discharge lamp and to an electronic ballast, for the operation of at least one gas discharge lamp, with the aid of which a rectifier effect appearing in the gas discharge lamp can be detected.

Gas discharge lamps are, as is known, operated with the aid of so-called electronic ballasts.

Such an electronic ballast is known for example from EP-B1-0 338 109. FIG. 10 shows the basic structure of this electronic ballast.

2. Description of the Related Art

The electronic ballast shown in FIG. 10 includes first a circuit A which is connected to the a.c. mains. This circuit A serves as HF-harmonics filter for reducing the higher-order harmonics of the mains frequency and for elimination of radio interference.

A rectifier circuit B is connected to the circuit A, which rectifier circuit transforms the mains voltage into a rectified intermediate voltage and supplies this via a harmonics filter C, which serves for smoothing the intermediate voltage, to an inverter circuit D. This inverter circuit D serves quasi as controllable a.c. voltage source and converts the d.c. voltage of the rectifier B into a variable a.c. voltage. The inverter D includes as a rule two (not shown) controllable switches, for example MOS field effect transistors. The two switches are connected in the form of a half-bridge circuit and are so alternatingly controlled with the aid of a corresponding bridge driver that in each case one of the switches is switched on and the other switched off. The two inverter switches are, thereby, connected in series between a supply voltage and ground, whereby at the common node between the two inverter switches a load circuit or output circuit E is connected, in which a gas discharge lamp or fluorescent lamp G is arranged. This output circuit E includes a series resonance circuit via which the "chopped" high frequency a.c. voltage of the inverter D is supplied to the fluorescent lamp G.

Before the application of the ignition voltage to the fluorescent lamp G, the lamp electrodes of the fluorescent lamp G are pre-heated, in order to extend the lifetime of the lamp. The pre-heating can be effected for example with the aid of a heating transformer the primary winding of which is connected with the series resonance circuit, whereas the secondary winding of the heating transformer is coupled with the individual lamp coils. In this way it is possible to supply the lamp coils with energy also in ignited operation. In pre-heating operation, the frequency of the a.c. voltage delivered from the inverter D is so altered, with regard to the resonance frequency of the series resonance circuit of the output circuit E, that the voltage applied to the gas discharge lamp G does not cause ignition of the lamp. In this case there flows through the lamp electrodes of the lamp, in the form of coils, a substantially constant current by means of which the lamp coils are pre-heated. After conclusion of the pre-heating phase the frequency of the a.c. voltage delivered from inverter D is displaced into the vicinity of the resonance frequency of the series resonance circuit, whereby the voltage applied to the gas discharge lamp G increases so that the gas discharge lamp G is ignited.

During the pre-heating, ignition and operation of the gas discharge lamp G, certain fault conditions can appear which are to be identified in order to be able to appropriately react thereto. For this purpose, the electronic ballast has a control circuit F which monitors various circuitry parameters of the electronic ballast and upon a limit value being exceeded generates a corresponding control signal for the inverter D in order to alter the frequency of the a.c. voltage generated from the inverter D in dependence upon the detected fault condition. Thus, for example, the control circuit F can monitor the lamp voltage, the pre-heating voltage, the lamp operating current, the impedance phase angle of the output circuit E or the d.c. voltage generated from the rectifier B and can so set the inverter frequency that the lamp voltage, the pre-heating voltage or the lamp current do not exceed a predetermined limit value, the d.c. power taken from the rectifier B is as constant as possible, or a capacitive operation of the series resonance output circuit E is avoided.

As also in the case of other lamps, with gas discharge lamps there appears, as a result of wear manifestations of the heating coils, at the end of the lifetime of the gas discharge lamp, the effect that the lamp electrodes wear out unevenly with time, i.e. the degradation of the emission layers on the lamp electrodes is different. Due to this different wear of the lamp electrodes there arise differences in the emission capabilities of the two lamp electrodes.

This difference in emission capabilities has the consequence that in the gas discharge lamp concerned there flows from the one lamp electrode to the other a higher current than vice versa, so that the temporal development of the lamp current exhibits an excess during one half-wave. Due to the different degradation of the two lamp electrodes there thus come about asymmetries which bring about not only a strong light flickering at the end of the lifetime of the gas discharge lamp, but in the extreme case allow an operation of the gas discharge lamp only during one half-wave, i.e. during the excessive half-wave. The gas discharge lamp acts in the same way as a rectifier, so that the above-described effect is called the "rectifier effect".

At that lamp electrode which, with time, has worn more strongly, the emission work function of the electrons is greater than at the less strongly worn electrode. As emission work function there is generally meant the minimum energy which is needed to remove an electron from a metal, in this case from the lamp electrode. The dipole layer at the surface of the metal, i.e of the lamp electrode, is thereby an important factor for defining the emission work function. The more strongly worn lamp electrode, having a greater emission work function for the electrons, as a consequence heats up more strongly than the less strongly worn electrode upon putting into operation the gas discharge lamp. The heating of the lamp electrode can in particular with lamps of having small diameter be so great that parts of the lamp glass bulb may even melt. In order to avoid the danger of accident resulting from the heating of the lamp glass bulb during the operation of the gas discharge lamp, the rectifier effect must consequently be recognised and, if appropriate, the gas discharge lamp switched off or its power take-up reduced.

In this regard, it is already known to detect the appearance of a rectifier effect by monitoring the lamp current flowing through the gas discharge path of the lamp. With the aid of this process there can be directly recognised emission differences of the lamp electrodes, but the evaluation of these emission differences and the realisation of this recognition process in a monitoring circuit configured as an integrated circuit is problematic. Alternatively, the rectifier effect can be recognised also by means of monitoring of the peak value of the lamp voltage since the asymmetries appearing in the lamp current are carried over to the lamp voltage. If, for example, the lamp voltage exceeds a particular limit value as a result of the asymmetric emission of the lamp electrodes, the gas discharge lamp is automatically switched off. With this recognition process it is however disadvantageous that the sensitivity of the process is very limited since in the case of a fault, i.e. upon appearance of the rectifier effect, the peak value of the detected lamp voltage is only 60% higher than in normal operation. Further, upon dimming of the gas discharge lamp, the lamp voltage changes so that it may occur that upon dimming of the gas discharge lamp there is erroneously determined the presence of the rectifier effect as a result of the thereby increased lamp voltage. Overall, the detection of the rectifier effect with the aid of a monitoring of the peak value of the lamp voltage is thus problematic.

SUMMARY OF THE INVENTION

The present invention is thus based on the object of proposing a possibility for the detection of the rectifier effect appearing in a gas discharge lamp such that the rectifier effect can be detected more simply and in particular more precisely.

In accordance with the invention this object is achieved by means of a process described hereinafter and a corresponding electronic ballast also described hereinafter.

In accordance with the present invention it is proposed to detect the lamp voltage, or a parameter dependent thereupon, but in accordance with the present invention the detected parameter is integrated and then the integration result evaluated. Advantageously, the lamp voltage is thereby integrated over a whole period or over a multiple of a whole period of the lamp voltage and it is then determined that the rectifier effect is present if the integration result deviates from zero. If the detected lamp voltage or the parameter dependent thereon is superimposed with a d.c. component, then this d.c. component—rather than zero—is given as desired value for the integration result.

In practice, the presence of the rectifier effect is only determined upon if the integration result lies outside a predetermined desired value range. The reliability of the recognition of the rectifier effect can be further improved in that the presence of the rectifier effect is only determined upon if the integration results deviates from the predetermined desired value or from the predetermined desired value range a plurality of times in succession. This is sensible because the rectifier effect is a fault which appears insidiously so that in the recognition of the rectifier effect it must be ensured that the presence of a rectifier effect is not determined upon, and correspondingly reacted to, too hastily. It can thus be provided that the presence of the rectifier effect is only determined upon if the integration result deviates from the predetermined desired value, or from the predetermined desired value range, 32 times in succession each 255th period of the lamp voltage.

In accordance with a preferred exemplary embodiment of the present invention, the lamp voltage—or the parameter dependent thereon—is "integrated" in that the duration of the positive half-wave of the detected parameter is compared with the duration of the negative half-wave so that the presence of a rectifier effect is then determined upon if the difference of the temporal durations of the positive and negative half-waves exceeds a predetermined tolerance value or tolerance range. In this case there can in particular be employed a counter which receives a reference timing signal and then upon zero crossing of the detected parameter is started, in order to count up or count down during the following half-period. When the detected parameter again reaches a zero crossing the counter begins to count in the opposite direction. Thus, in order not to determine upon the presence of the rectifier effect, the counter must—after one period of the detected parameter—have again reached its initial count value, or its final count value must lie within a predetermined tolerance range in the vicinity of the initial count value.

BRIEF DESCRIPTION OF THE DRAWINGS

The invention will described in more detailed below with reference to an exemplary embodiment and with reference to the accompanying drawings.

DETAILED DESCRIPTION OF THE PREFERRED EMBODIMENT

Figure 1:
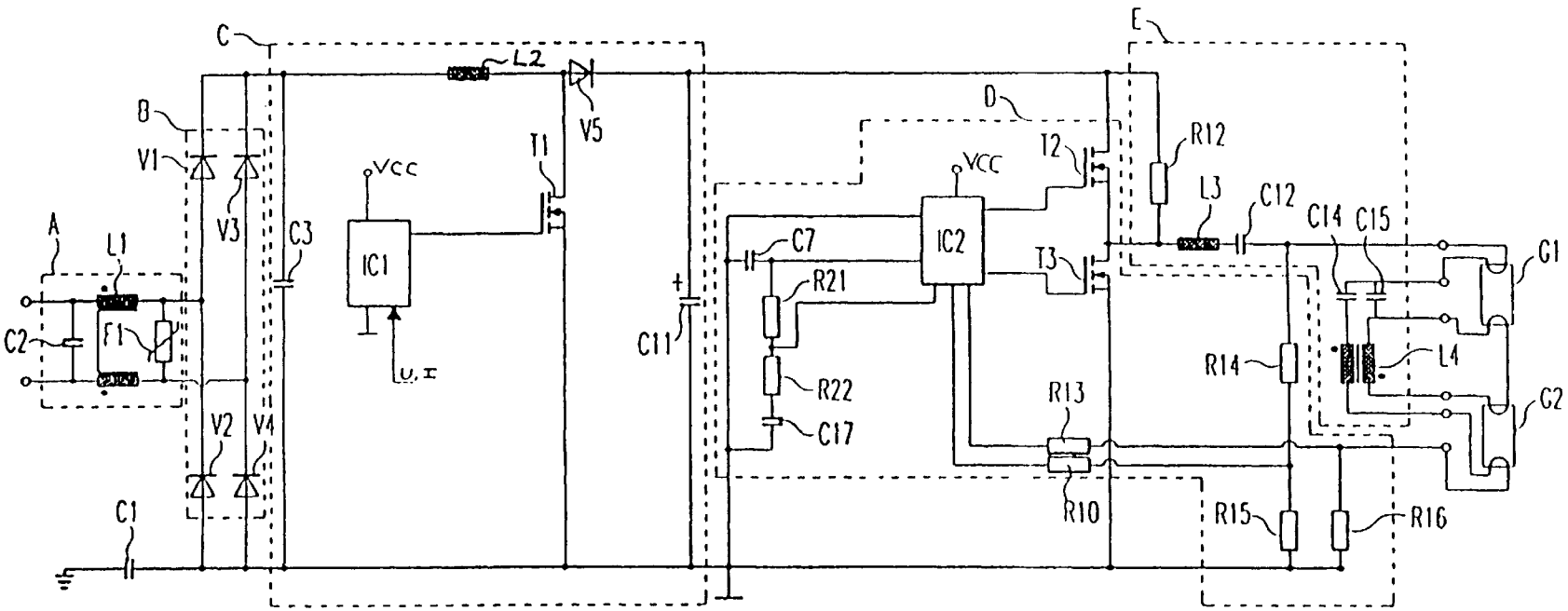
FIG. 1 shows a circuit diagram of a preferred exemplary embodiment of an electronic ballast in accordance with the invention.

The electronic ballast shown in FIG. 1 includes first a circuit A, which is connected on the input side to a supply voltage, for example a mains voltage, and which serves for elimination of radio interference. The circuit A is constructed in conventional manner and includes for example capacitive input filters and if appropriate harmonics chokes. In FIG. 1 capacitor C2 and a symmetry transformer L1 are illustrated by way of example, whereby a surge diverter or a VD resistance with the reference F1 may be connected in parallel.

The circuit B connected to the circuit A includes a full-wave rectifier bridge having diodes V1–V4. The rectifier circuit B transforms the supply a.c. voltage applied at the input side into a rectified intermediate voltage. The rectifier circuit B can be omitted if the electronic ballast is operated with d.c. voltage.

The following circuit part C serves for harmonics filtering and smoothing of the intermediate voltage delivered by the rectifier B. The circuit C shown in FIG. 1 includes for example capacitors C3, C11, a diode V5, a coil L2, a MOS field effect transistor T1 and a control circuit IC1 provided as an integrated circuit. The control circuit IC1 is connected to a supply voltage potential VCC and can be so connected with the other circuitry elements that it receives various voltage potentials U or currents I. The construction of circuit C shown in FIG. 1 is to be understood as purely exemplary.

An inverter circuit D is controlled by the harmonics filter C shown in FIG. 1, which inverter circuit has as main elements two controllable switches, in the present example in the form of MOS-field effect transistors T2 and T3, connected in series between a supply voltage line and ground. The two inverter switches T2, T3 are connected in a half-bridge and are controlled in each case with the aid of a control circuit IC2 formed as an integrated circuit, i.e. opened and closed. The control circuit IC2 thus assumes at the same time the function of a bridge driver and is connected to a corresponding supply voltage line VCC or coupled therewith. The inverter circuit D generates, in dependence upon the rectified intermediate voltage generated by the rectifier B, an a.c. voltage having variable frequency and/or duty ratio. In general, the inverter D is constructed in conventional manner and its function is sufficiently well known that a further explanation thereof can be omitted. Of significance at this point is only that the control circuit IC2 alternatingly controls the two inverter switches T2 and T3, in dependence upon the control signals delivered to the control circuit, so that at the connection point between the two inverter switches T2 and T3 a "chopped" high frequency a.c. voltage appears.

A series resonance output circuit or load circuit E is connected with the inverter D. In the present case, the load circuit E is configured for the connection of two gas discharge lamps G1, G2 in tandem configuration. Of course, the load circuit E can be so modified that only one gas discharge lamp, or more than two gas discharge lamps, can be operated. From FIG. 1 it can be seen that the load circuit E has a series resonance circuit consisting of a resonance circuit coil L3 and a resonance circuit capacitor C14. This series resonance circuit or the resonance circuit coil L3 is connected to the connection point between the two inverter switches T2 and T3 and the resonance circuit capacitor C14 is so arranged that it is connected parallel to the gas discharge lamp to be operated, or the gas discharge lamps G1, G2 to be operated. The high frequency a.c. voltage generated by the inverter D is supplied to the gas discharge lamps G1 and G2 via the series resonance circuit.

As has already been explained, in accordance with the example shown in FIG. 1, the two gas discharge lamps G1 and G2 are connected in tandem configuration to the load circuit E, or to the electronic ballast. This means that—as can be seen from FIG. 1—the upper coil of the upper gas discharge lamp G1 and the lower coil of the lower gas discharge lamp G2 are connected directly to the load circuit E, whereas the lower coil of the upper gas discharge lamp G1 and the upper coil of the lower gas discharge lamp G2 are connected with one another and connected to the load circuit E. Before the application of the ignition voltage to the gas discharge lamps G1, G2 these are pre-heated, in order to extend the lifetime of the gas discharge lamps. For this purpose there is provided in accordance with FIG. 1 a heating transformer L4, the primary winding of which is connected in series with the resonance circuit capacitor C14, whereas the secondary winding connects together the lower coil of the upper gas discharge lamp G1 and the upper coil of the lower gas discharge lamp G2. In pre-heating operation the frequency of the a.c. voltage delivered by the inverter E is so set, with regard to the resonance frequency of the series resonance circuit, that the voltage supplied via the resonance circuit capacitor C14 and thus via the gas discharge lamps G1 and G2 does not bring about ignition of the gas discharge lamps. In this case there flows through the coils of the gas discharge lamps G1, G2 a substantially constant pre-heating current. The capacitor C15 illustrated in FIG. 1 brings about adaptation of the pre-heating voltage with the tandem configuration of the gas discharge lamps G1 and G2 illustrated in FIG. 1. The above explained principle of pre-heating can of course be applied in a simple manner also to the operation of one gas discharge lamp or more than two gas discharge lamps. Further, apart from the tandem configuration, there is conceivable also a parallel configuration or parallel connection of a plurality of gas discharge lamps G1, G2. In FIG. 1 there is illustrated, however, the tandem configuration of the gas discharge lamps G1, G2 since with such a lamp configuration, with the aid of the electronic ballast illustrated in FIG. 1, a lamp exchange both of the upper and also of the lower gas discharge lamp can be identified advantageously in a simple manner. Lamp exchange recognition will be explained in more detail below. For the purpose of lamp exchange recognition there serves inter alia also the resistance R12 illustrated in FIG. 1.

After conclusion of the pre-heating phase, via the control circuit IC2 the frequency of the a.c. voltage delivered by the inverter D is displaced into the vicinity of the resonance frequency of the series resonance circuit, whereby the voltage applied at the resonance circuit capacitor C14 and the gas discharge lamps G1, G2 is increased, whereby these gas discharge lamps ignite.

After ignition of the gas discharge lamps, the electronic ballast illustrated in FIG. 1 moves into the actual operational phase in which the frequency of the a.c. voltage delivered by the inverter D is for example continuously so set that a lamp current as constant as possible flows through the gas discharge lamps G1, G2 or a lamp voltage which is as constant as possible is applied to the gas discharge lamps. As will be described in more detail below, the electronic ballast shown in FIG. 1 has a series of fault detectors which monitor particular circuitry parameters of the electronic ballast, in particular of the load circuit E, and upon detection of a particular fault bring about a corresponding control of the inverter D, in order for example to avoid the appearance of an over-voltage at the gas discharge lamps G1 and G2, a rectifier effect in the gas discharge lamps G1 and G2 or a capacitive operation of the load circuit E.

For the control of the inverter D there serves a circuit module which includes as main component the control circuit IC2 already mentioned above and a plurality of external components as external connections of the control circuit IC2. The main external components are six resistances R10, R13–R16 and R21, R22 and two capacitors C7 and C17. As is shown in FIG. 1, the individual external components are connected to respective input terminals of the control circuit IC2. The external components connected with the control circuit IC2 serve primarily for the detection of particular circuitry parameters of the electronic ballast, so that these can be evaluated in the control circuit IC2.

Figure 2:
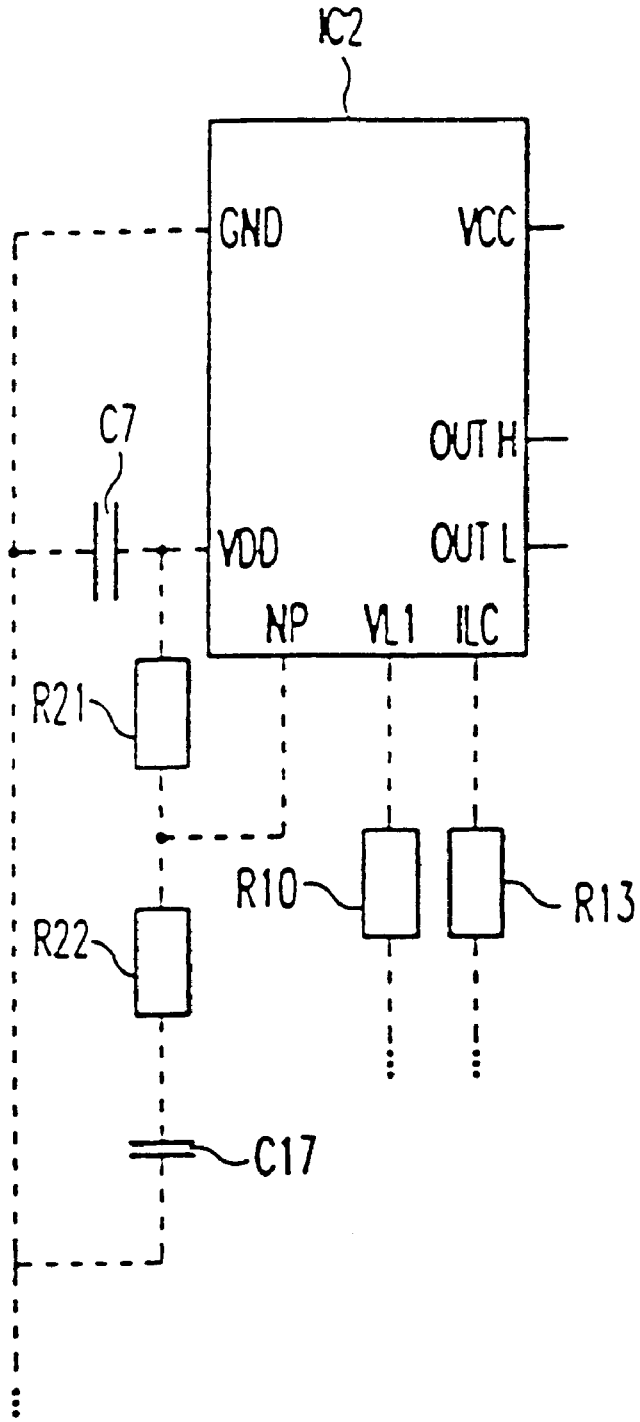
FIG. 2 shows an enlarged representation of a control circuit illustrated in FIG. 1, with corresponding external connection of this control circuit.

FIG. 2 shows an enlarged illustration of the control circuit IC2 illustrated in FIG. 1 and the external connections of the individual input terminals of the control circuit IC2. Thereby, in FIG. 2 only the main terminals and external components are illustrated. In the present example, the control circuit IC2 is constituted advantageously as an application specific integrated circuit ASIC and accommodated in a multi-pole SMD (Surface Mounted Device) housing. In the present case, the control circuit IC2 is suitable both for the operation of a single lamp output circuit E and also for the operation of a load circuit configured for a tandem configuration with a plurality of gas discharge lamps shown in FIG. 1.

As has already been explained and is particularly apparent from FIG. 2, the control circuit IC2 has a plurality of terminals which have the following functions. There is supplied to the terminal GND the reference potential, i.e. the ground potential, for the individual analog and digital functional blocks of the control circuit IC2. It is apparent from FIG. 1 that the ground potential of the overall electronic ballast is earthed via a coupling capacitor C1. At the terminal VDD, which is connected via the coupling capacitor C7 with the ground potential (c.f. FIG. 1) there is made available the internally generated supply voltage for the individual analog and digital functional blocks of the control circuit IC2. The terminal NP serves, as will be explained in more detail below, for the external setting and recognition of the pre-heating method, i.e. for the selection between a cold start operation and a warm start operation. In particular, the terminal NP is so externally connected that a dynamic selection of the pre-heating method is possible. The terminal VL1 detects via the resistances R10 and R14, R15—illustrated in FIG. 1 and partially in FIG. 2—the divided-down lamp voltage of the gas discharge lamps G1, G2 and thus serves primarily for lamp voltage monitoring. Analogously, the terminal ILC serves with the aid of the resistances R13 and R16—shown in FIG. 1 and partially in FIG. 2—for monitoring of the output circuit current or load circuit current (choke current) or for monitoring of the lamp current flowing through the gas discharge lamps G1, G2 after their ignition, in that with the aid of the shunt resistance R16 a voltage proportional thereto is detected and delivered to the control circuit via the terminal ILC. The terminal VL1 thus serves for voltage monitoring, whereas the terminal ILC serves for current monitoring. The two output terminals OUTL and OUTH serve for control of the lower and upper switches T3 and T2 shown in FIG. 1. For this purpose there are made available at the output terminals OUTL and OUTH control signals (TTL level) for the switching on and switching off of the two inverter switches T2 and T3. Finally, the terminal VCC of the control circuit IC2 is the central supply voltage terminal of the control circuit IC2.

The supply voltage range may for example include 10–18V. Further, the control circuit IC2 so controls the inverter switches T2 and T3 that from the output side of the inverter circuit D an a.c. voltage of variable frequency having a operating frequency range of for example 40–80 kHz is generated.

The control circuit IC2 forms the centrepiece of the overall electronic ballast illustrated in FIG. 1 and accordingly includes a plurality of different functions. Thus, for example, with the aid of the control circuit IC2 the pre-heating method for the connected gas discharge lamp(s) can be dynamically determined and switching between a cold start operation and a warm start operation can be effected. For this purpose, the control circuit IC2 provides for a defined pre-heating operation with a defined pre-heating time and a defined pre-heating current. Likewise, the control circuit IC2 provides for a predefined ignition operation with a determined ignition time and a determined ignition voltage. Via the terminals ILC and VL1 of the control circuit IC2, for example the pre-heating current and the lamp operating current or the lamp voltage can be detected and controlled to a value as constant as possible. Further, via the current terminal ILC the control circuit IC2 monitors a capacitive operation of the load circuit E. Via the voltage terminal VL1 there can further be detected the appearance of a rectifier effect in a connected gas discharge lamp G1, G2. Likewise, with the aid of the voltage terminal VL1, the appearance of gas defect, which leads to an over-voltage of the corresponding gas discharge lamp, can be detected and correspondingly the electronic ballast can be switched off in this case. A particular function of the control circuit IC2 is the recognition of a lamp exchange, whereby in the tandem configuration illustrated in FIG. 1 the lamp exchange recognition is in particular independent of the exchanged lamp, i.e. both an exchange of the upper gas discharge lamp G1 and also of the lower gas discharge lamp G2 can be recognized. Finally, in the control circuit IC2 there is realised a (preferably digitally implemented) process control which provides that the gas discharge lamp(s) connected to the electronic ballast are controlled in accordance with predetermined operating states whereby a change from one operating state to a new operating state can be effected only when at least one particular condition is fulfilled. Within each operating state there is possible a monitoring of particular parameters of the electronic ballast in dependence upon the operating state, so that depending upon the respective operating state different fault parameters can be monitored and differently evaluated. With regard to the faults, there is effected in particular an event filtered fault evaluation, i.e. with the aid for example of digital event filters it is ensured that the presence of a fault is only determined upon if the corresponding fault actually appears several times successively.

Along with the above briefly summarised functions, the control circuit IC2 has further functions which will all be explained in more detail below with reference to the accompanying drawings.

Figure 3:
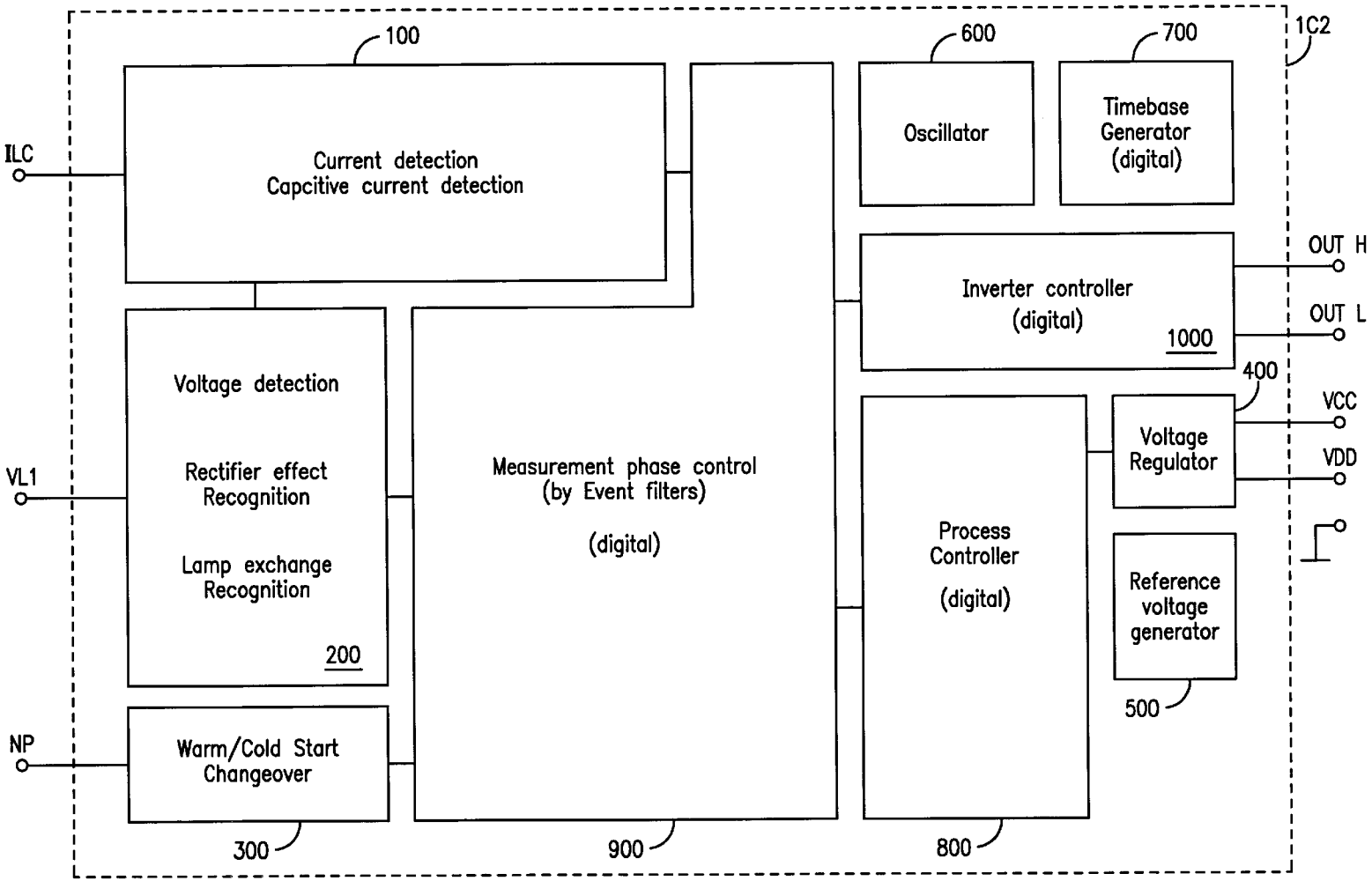
FIG. 3 shows a block circuit diagram of the control circuit shown in FIG. 2.

FIG. 3 shows a block circuit diagram of the internal structure of the above-described control circuit IC2. First, there is coupled with the current terminal ILC a module 100 which serves inter alia for the above explained current detection and capacitive current detection of the load circuit. The evaluation of the current detected via the terminal ILC is effected in particular with the aid of a regulator formed by means of a comparator circuit. In order to keep the outlay in terms of circuitry really low, there is delivered to and evaluated with this comparator circuit also the voltage signal received by the voltage terminal VL1 of the control circuit IC2 and processed by a module 200. The module 200 serves in particular for the detection of the lamp voltage, for recognition of the rectifier effect and for recognition of lamp exchange. Further, there is coupled with the terminal NP a further module 300 which serves for the recognition of warm start operation or cold start operation upon pre-heating of the gas discharge lamp(s) to be controlled and for the realisation of a dynamic pre-heating operation. There is connected with the supply voltage terminals VCC and VDD a voltage regulation module 400 which has an internal voltage regulator which makes available a regulated, very precise voltage for the voltage supply of all internal function blocks. A further module 500 serves as source for all necessary reference parameters, i.e. reference voltages and reference currents, in the control circuit IC2. An oscillator 600 serves as internal clock of the control circuit IC2, whereby a timebase generator 700 coupled therewith derives in dependence upon the predetermined timing of the oscillator 600 internal temporal parameters for the process control of the control circuit IC2, such as e.g. the pre-heating or ignition time. A further module 800 serves for the realisation of the process control of the individual operating states of the overall electronic ballast and cooperates closely with a further module 900 which serves for measurement phase control. The module 900 serves in particular for event filtered evaluation of particular fault parameters of the electronic ballast and for the measurement phase dependent control of all switches of the individual function blocks of the control circuit IC2. The process controller 800 evaluates the event filtered condition reports of the measurement phase controller 900 and controls the individual operating states of the electronic ballast or of the control circuit IC2 in dependence upon the temporal parameters predetermined by the timebase generator 700. Finally, the control circuit IC2 has a further module 1000 for the purpose of inverter control. With the aid of this module 1000, frequency setting signals delivered from the measurement phase controller 900 are transformed into corresponding control signals for the upper inverter switch (via the output terminal OUTH) and the lower inverter switch (via the output terminal OUTL).

The control circuit IC2 may include both analog and also digitally implemented functional blocks. In the present case, the digital part of the control circuit IC2, formed as an ASIC, includes the timebase generator 700, the process controller 800, the measurement phase controller 900, and the inverter controller 1000. In particular, the control circuit IC2 can be so equipped that the digital part corresponds to the analog part with regard to the area requirements of the control circuit IC2.

Figure 4:
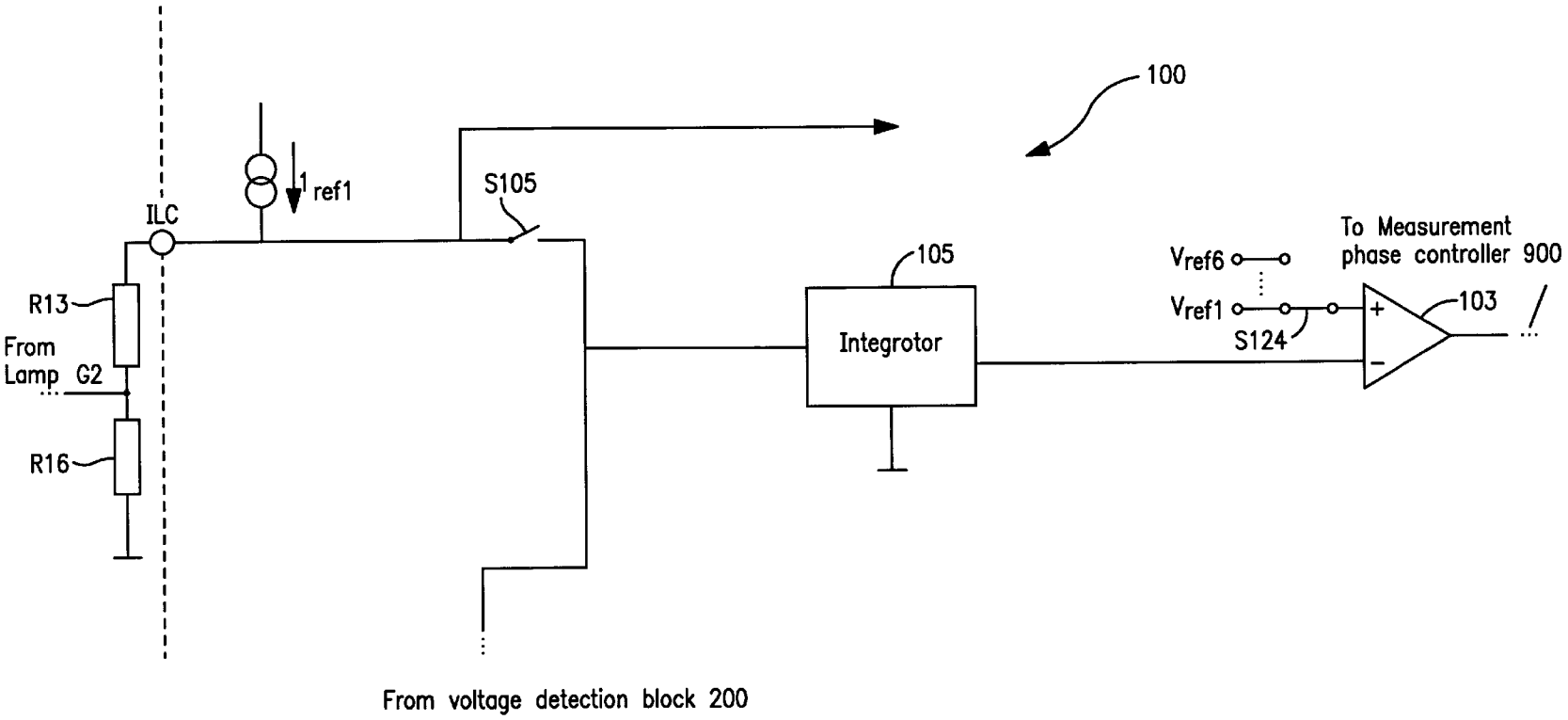
FIG. 4 shows a circuit diagram of, a current detection block illustrated in FIG. 3, FIGS. 5*a* and 5*b* show illustrations for the purpose of explanation of the detection of capacitance current with the aid of the current detection block shown in FIGS. 3 and 4.

FIG. 4 shows a more detailed circuit diagram of the current detection module 100 illustrated in FIG. 3. In FIG. 4 there are also shown the resistances R13 and R16 which are connected externally with the current terminal ILC of the control circuit, which resistances are also shown in FIG. 1.

Internally a reference current Iref1 is added to the signal detected at the current terminal ILC, in order to ensure that the signal to be processed by the current detection module 100 always lies within the working voltage range of the control circuit.

As is shown in FIG. 4, an integrator circuit 105 is provided which serves for the integration of the input signal delivered thereto. The complete functional block 105 is so realised that the integrator function can be employed both for the measurement of the lamp current (via the terminal ILC) in normal operation and also for recognition of the rectifier effect (via the terminal VL1).

The integrator circuit 105 may have sample-and-hold members which alternately, in each period of the internal timing generator (c.f. module 600 in FIG. 3) sample the input signal of the integrator. The charge thereby stored in the sample-and-hold members is supplied to an integration amplifier of the integrator circuit 105. This procedure is cyclically repeated.

The integrator 105 may have an internal controllable switch which bridges the above-mentioned sample-and-hold members and which is closed over the duration of the offset compensation of the integrator 105. In this way, there can be applied to the actual integration amplifier during the initialisation phase any arbitrary signal, in particular the signal at the input terminal ILC, via the switch S105, or a reference voltage potential for recognition of the rectifier effect, from the voltage block 200 via the switch S107.

The actual integration amplifier of the integrator 105 has the task of integrating, temporally exactly controlled, the current measurement signal at the ILC terminal. In the case that the current measurement signal at the ILC terminal is integrated by the integration amplifier of the integrated circuit 105, the switch S105 is closed, whereas in the case of evaluation of the rectifier effect the reference potential for the rectifier effect evaluation supplied via the switch S107 is applied to the integrator circuit 105.

Finally, as actual regulator there serves a comparator 103 which carries out the necessary desired value/actual value comparison and which is connected to the output of the integrator 105. By means of the arrangement of this comparator 103 shown in FIG. 4 it is possible to use the comparator 103 very flexibly. By means of corresponding activation of switch S124 there can be added or applied to the comparator 103 various reference voltages or reference values, whereby in FIG. 4 reference voltages Vref1–Vref6 are illustrated by way of example. The reference potential Vref1 and Vref2 thereby corresponds for example to a desired pre-heating voltage during a pre-heating operating state. Thus, during the pre-heating operation, the reference voltage Vref1 or Vref2 is applied to the comparator 103 with the aid of the controllable switch S124 so that the momentary and not integrated measurement signal applied to the ILC terminal is compared with the respectively applied reference value Vref1 or Vref2. In normal operation, the reference potential Vref3 corresponds for example to the integration starting value of the integration amplifier of the integrator 105 so that upon application of this reference potential Vref3 the comparator 103 can detect the actual variation of the integration result. The reference potentials Vref4 and Vref6 may correspond to a positive or negative limit value for the lamp voltage of the terminal VL1, supplied via the switch S107 and integrated, in order thereby to be able to reliably recognise the appearance of a rectifier effect by means of comparison with these two limit values in the case that the integration result overshoots in a positive or negative direction. For this purpose the further reference potential Vref5 is also employed which in the case of recognition of the rectifier effect is switched in and which corresponds to the initial or start value for the integration of the lamp voltage supplied via the switch S107. By taking into account the start values of the integration amplifier of the integrator 105 predetermined by means of the reference potentials Vref3 or Vref5 there can thus be determined with the aid of the comparator 103 the actually present variation of the corresponding integration parameter relative to the corresponding start value.

The output signal of the comparator 103 is delivered to the measurement phase controller 900 shown in FIG. 3, which evaluates this signal and evaluates it differently in dependence upon the momentary measurement phase. Thus, the measurement phase controller 900 provides for example for a corresponding adaptation of output frequency of the inverter of the electronic ballast in the case that the current measurement signal of the terminal ILC monitored by the comparator 103 deviates from the predetermined desired value Vref3. For the case of rectifier effect evaluation, however, the measurement phase controller generates, as will be explained more detail below, an event filtered signal which indicates whether a rectifier effect is present or not in a connected gas discharge lamp. This signal is evaluated by the process control block 800 shown in FIG. 3 and employed for the operating state control of the overall electronic ballast.

In the present case it is particularly proposed to regulate the peak value of the pre-heating current $I_{HZ}$ during the pre-heating operation. On the other hand, for normal operation, it is proposed to regulate the average value or the effective value of the lamp operating current $I_L$.

As is shown in FIG. 4, the measurement signal applied at the terminal ILC can also be monitored and evaluated without making use of the integrator circuit 105, in order for example to detect capacitive operation of the load circuit of the electronic ballast. For this purpose there may be provided a detector for detecting a capacitive current flowing in the load circuit, which for example determines the phase angle of the load circuit, i.e. the phase difference between the load circuit voltage and the load circuit current (capacitive current detection). The result of this monitoring or evaluation can also be supplied to the measurement phase controller 900.

The appearance of a capacitive current in the load circuit will be described in more detail below with reference to FIGS. 5*a* and 5*b*.

Figure 5A:
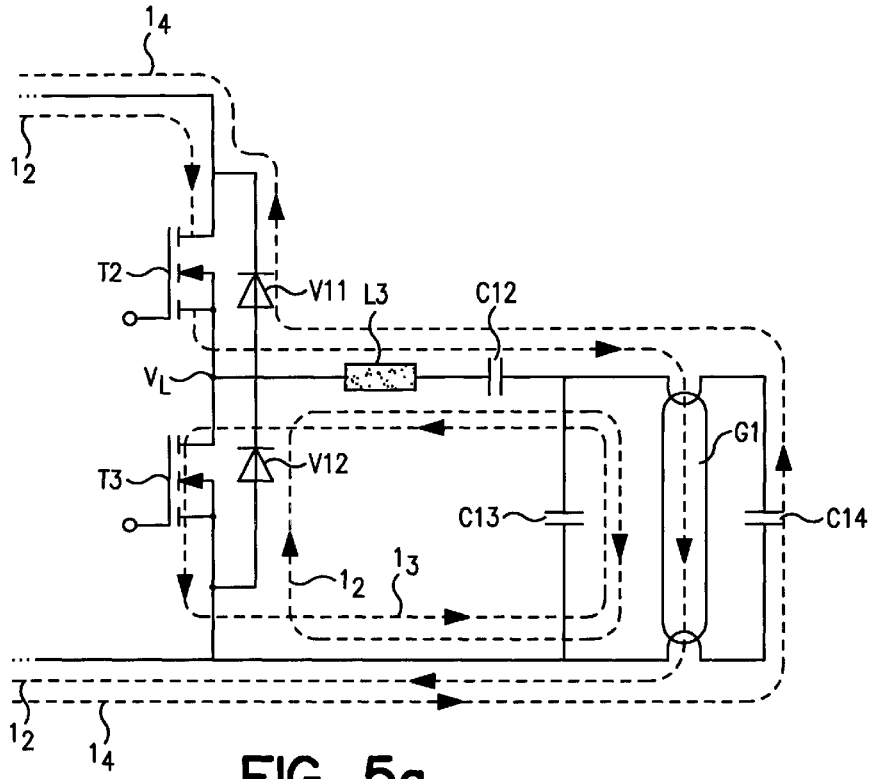

FIG. 5*a* shows an enlarged illustration of the main elements of the inverter D already illustrated in FIG. 1, and of the load circuit E. For the purpose of simplicity, it is assumed in FIG. 5*a* that only one gas discharge lamp G1 is connected to the load circuit. In FIG. 5*a* both of the series connected inverter switches T2 and T3 are illustrated. As is already shown in FIG. 1, the load circuit with its series resonance circuit is connected to the connection point between the two inverter switches T2 and T3, i.e. the resonance circuit coil L3 is connected with the resonance circuit capacitor C14 parallel to the lower inverter switch T3. The resonance circuit capacitor C14 is further connected parallel to the gas discharge lamp G1. There are connected in parallel to the individual inverter switches T2 and T3 free-running diodes V11 and V12, which serve to protect the respective inverter switches.

Figure 5B:
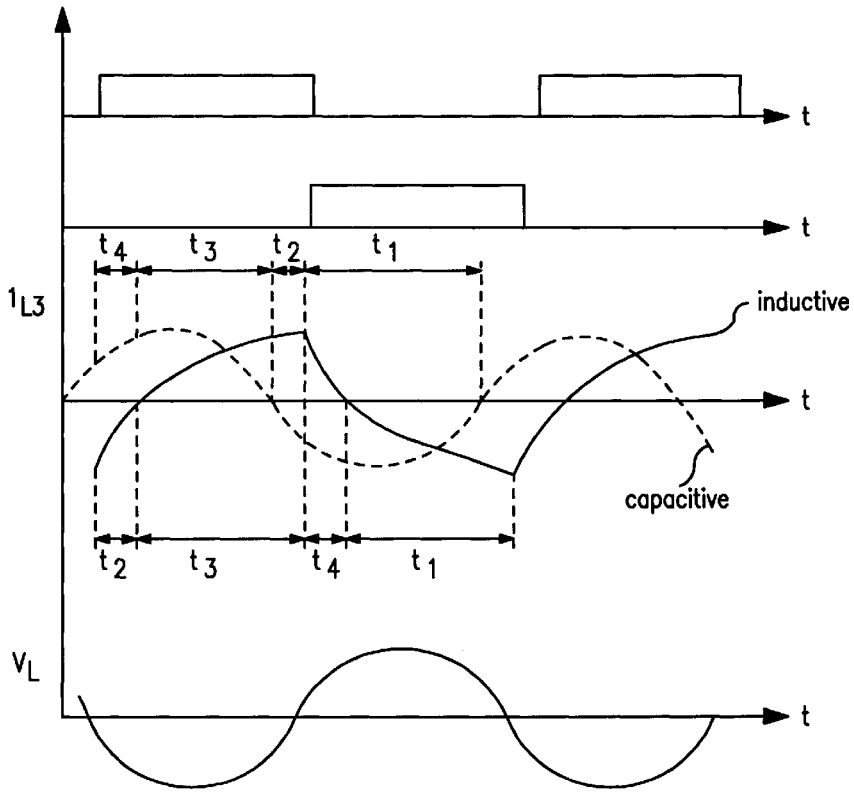

In FIG. 5*b* there are illustrated on the one hand the switch-on states of the two inverter switches T2 and T3 and the current development of the current $I_{L3}$ flowing via the choke L3 and the temporal development of the voltage potential $V_L$ appearing at the connection between the two inverter switches T2 and T3. At the switch-on time point of the upper or lower inverter switch T2 or T3, a current flows in the free-running diode of the inverter switch to be switched on and the inverter half-bridge switches the resonance load circuit inductive, i.e. the voltage or the potential $V_L$ is in advance of the choke current $I_{L3}$. In contrast thereto, there stands the capacitive switching of the resonance load of the resonance load circuit. In this working region a current flows in the free-running diode opposite to the inverter switch to be switched on, whereby there appears a high blocking voltage at the forward current carrying free-running diode of one of the two inverter switches. This in turn leads to very high recovery currents whereby high switching losses appear in both inverter switches T2 and T3.

FIG. 5*a* shows the development of the individual currents $I_1$–$I_4$, which appear during the time intervals $t_1$–$t_4$ illustrated in FIG. 5*b* in the case of an inductive or capacitive choke current $I_{L3}$.

The above-mentioned phenomenon appears in particular with load circuit voltages $V_L$ having an output frequency in the vicinity of the resonance frequency of the series resonance circuit, which is particularly the case upon ignition of the gas discharge lamp G1, whereby initially an inductive current flows in the load circuit which leads to a heating of the coil L3. As a result of the heating of the coil L3, its inductance falls so that suddenly a transition from the inductive range into the faulty capacitive range appears.

For the recognition of the undesired capacitive operation of the load circuit the height of the current amplitude of the load circuit detected via the input ILC can now be monitored and can be compared with a fixedly predetermined reference value. Advantageously, the height of the current amplitude is in each case detected at the switch-on time point of the lower inverter switch T3 since in this case the polarities of the measurement values to be detected are favourable for the processing within the control circuit IC2 constituted as an ASIC. If the detected current value lies below the limit value predetermined by means of the corresponding reference potential, it is determined that a capacitive operation of the load circuit is present, and an output signal having a high level can be generated which is evaluated by the measurement phase control block 900 shown in FIG. 3 and then transformed by the inverter control block 1000 likewise shown in FIG. 3 into control signals for the two inverter switches T2 and T3 in such a manner that these switches are alternately switched on and switched off with an increased frequency, in order to increase the working frequency and thus to counter the capacitive operation.

Below, there will be explained in more detail with reference to FIG. 6 the construction and the function of the voltage detection block 200 already indicated in FIG. 3, which block evaluates or processes the measurement signals applied at the voltage terminal VL1.

Figure 6:
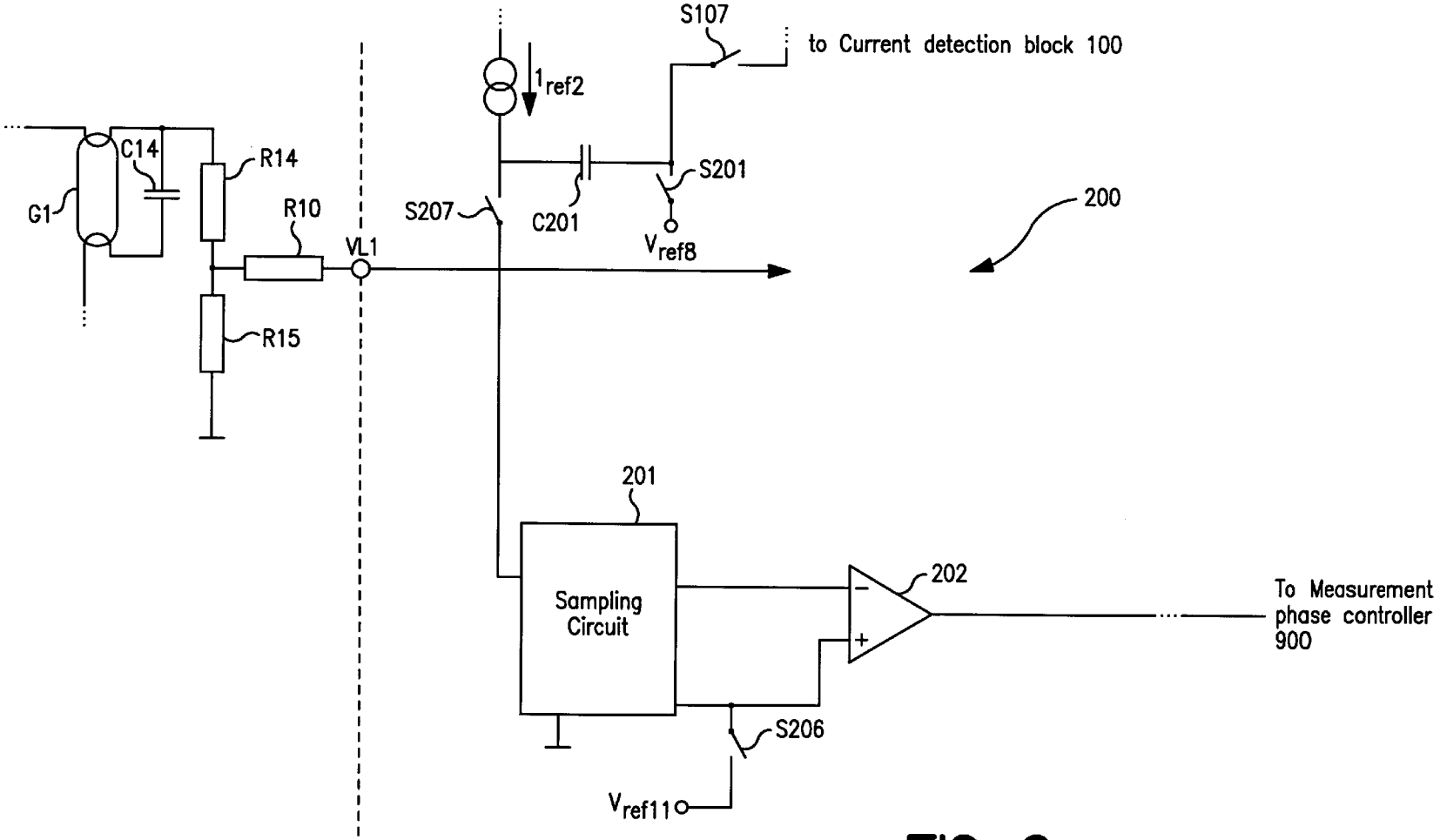
FIG. 6 shows a circuit diagram of a voltage detection block illustrated in FIG. 3, with the aid of which in combination with the current detection block illustrated in FIG. 4 the appearance of a rectifier effect is recognised.

FIG. 6 thereby shows on the one hand the internal construction of the voltage detection block 200 and the external connections of the control circuit coupled with the terminal VL1 of the voltage detection block 200. In particular it can be seen from FIG. 6, in correspondence with FIG. 1, that a series resistance R10 is coupled on the one hand with the terminal VL1 and on the other hand with a voltage divider consisting of resistances R14 and R15, whereby the two voltage divider resistances R14 and R15 are connected parallel to the gas discharge lamp G1 or to the gas discharge lamps G1 and G2 connected in tandem form in FIG. 1. For the purpose of simplicity it is assumed in FIG. 6, in contrast to FIG. 1, that only one gas discharge lamp G1 is controlled with which also the resonance circuit capacitor C14 is connected in parallel.

The two resistances R14 and R15 have the task of dividing down the voltage applied at the gas discharge lamp G1, so that with the aid of the resistance R10 tapping the connection point between the resistances R14 and R15 a measurement signal representative of the lamp voltage can be supplied to the voltage terminal VL1 of the voltage detection block 200.

Advantageously, the three external resistances R10, R14 and R15 are variable, so that—analogously to the current terminal ILC (c.f. the resistances R13, R16)—via a terminal of the control circuit a total of three different regulation parameters of the electronic ballast can be set or controlled with the aid of one and the same regulator to different time points completely independently of one another. By means of setting of the resistance values of the resistances R10, R14 and R15 there can accordingly be set or predetermined, dependent upon the currently employed lamp type or the currently employed electronic ballast type, the desired values for the regulation of the three different regulation parameters. In the present case there can be set with the aid of the three external variable resistances R10, R14 and R15 the following parameters of the electronic ballast: the maximum lamp voltage positive/negative, the amplitude of the a.c. voltage component of the lamp voltage signal and the signal peaking of the lamp voltage signal for evaluation of the rectification effect.

As can be understood from FIG. 6, there is again provided an internal reference current source which acts upon the measurement signal applied to the voltage terminal VL1 with an additional internal current Iref2. In contrast to the ILC terminal illustrated in FIG. 4, in this case however the reference current Iref2 is activated with the aid of the controllable switch S207 only during the evaluation of the rectifier effect, i.e. closed. All other further evaluations related to the VL1 terminal are concerned with the signal applied to the terminal VL1 without additional reference current Iref2, i.e. without d.c. current offset. Correspondingly, during the rectification effect evaluation all other detectors at the VL1 terminal are deactivated since they would otherwise deliver false results.

By means of the switching-in of the reference current Iref2 the signal applied at the terminal VL1 is again raised. Analogously to the feeding in of the reference current Iref1 at the current terminal ILC shown in FIG. 4 this is, however, in the case of evaluation of the rectifier effect not adverse since—as will be explained in more detail below—the recognition of the rectifier effect is carried out by means of evaluation of the output signal of the integrated circuit shown in FIG. 4, whereby as a consequence of the averaging by of the integrated circuit the d.c. current component Iref1 or Iref2 is eliminated.

First, the recognition of the rectifier effect with the aid of the present control circuit will be described in more detail. As also with other lamps, there appears with gas discharge lamps as a result of wear effects of the heating coils at the end of the lifetime of the gas discharge lamp the effect that the lamp electrodes wear out unevenly with time, i.e. the degradation of the emission layers on the lamp electrodes is different. Because of the different wear of the lamp electrodes there arise differences in the emission capabilities of the two lamp electrodes. This has the consequence that upon operation of the corresponding gas discharge lamp there flows from one lamp electrode to the other a higher current than vice versa. The temporal development of the lamp current thus manifests an excess of one half-wave. Through the different degradations of the two lamp electrodes there thus arise asymmetries which lead not only to a strong light flickering at the end of the lifetime of the gas discharge lamp, but which in an extreme case permit operation of the gas discharge lamp only during one half-wave. In this case, the gas discharge lamp acts as a rectifier, so that the above-described effect is designated as "rectifier effect".

The above explained rectifier effect has further the consequence that the more strongly worn electrode which exhibits a higher emission work function than the other electrode heats up more strongly than the other electrode upon bringing the gas discharge lamp into operation. As emission work function there is meant in general the minimal energy which is necessary to release an electron from metal, in the present case from a lamp electrode. The above-described heating of the lamp electrode can, in particular with lamps of small diameter, be so strong that parts of the lamp glass bulb may melt.

Thus, with the aid of the present control circuit, each controlled lamp is monitored with regard to the appearance of a rectifier effect, so that upon recognition of a rectifier effect an appropriate reaction may take place.

As indicated above, the actual recognition of the rectifier effect does not occur in the voltage detection block 200 illustrated in FIG. 6 but in the current detection block 100, since for rectification effect recognition the integrator circuit of the current detection block 100 and the downstream connected comparator 103 (c.f. FIG. 4) are also employed. In this manner, the number of components needed for the monitoring of the electronic ballast or of the gas discharge lamp(s) can be reduced.

In the voltage detection block 200 shown in FIG. 6 there is effected only the signal processing of the measurement signal applied to the terminal VL1. For this purpose the switch S207 is first closed in order to raise more positive the a.c. voltage signal applied to the terminal VL1. At the downstream coupling capacitor C201 there can only pass, however, only the a.c. voltage component of the thus processed measurement signal. Therefore, after the coupling capacitor C201, the signal must be again raised, which after conclusion of a particular build up time with regard to the current source Iref2 is effected by means of closing a switch S201. Thereby, for the new raising of the measurement signal there is employed an internally defined, not externally influenced, reference voltage Vref8 which is thus known to the overall control circuit. In the case of the evaluation of the rectifier effect this internal reference voltage Vref8—as has already been described with reference to FIG. 4—is applied also to the integration amplifier of the integrated circuit 105.

Advantageously, the switch S207 shown in FIG. 6 is already closed some time before the expected zero crossing of the lamp voltage signal applied to the terminal VL1, so that build up processes caused by the capacitor C201 can not additionally corrupt the measurement signal. Exactly at the calculated zero crossing of the voltage, the switch S201 is again opened. The signal applied to the switch S107 shown in FIGS. 4 and 6 corresponds at this time point to the a.c. voltage amplitude at terminal VL1, whereas the d.c. component of the signal applied to the switch S107 corresponds to the switched-in reference voltage Vref8. By means of closing the switch S107 there is then—as already explained above—supplied to the integrated circuit 105 shown in FIG. 4 the so processed measurement signal of the terminal VL1. The switching condition of the switch S107 is controlled, as for all other controllable switches of the overall control circuit IC2, by the measurement phase controller 900 shown in FIG. 3. The individual switches shown in FIG. 4 are thereby so closed or opened by the measurement phase controller 900 that with the aid of the comparator 103 there is possible via the upstream integrator circuit an averaged evaluation of the current measurement signal applied to the terminal ILC or of the voltage measurement signal applied to the terminal VL1. Further, the comparator 103 can, by corresponding actuation of the controllable switch of the current detection block 100 shown in FIG. 4, also be directly connected with the current measurement terminal ILC, by-passing the integrator circuit, in order thus to evaluate or regulate the peak value of the current measurement signal at the terminal ILC. As has already been explained, by means of the measurement phase controller 900 it is determined which of the above described measurement or regulation states should be assumed.

The rectifier effect recognition principle realised with the present control circuit IC2 provides that the lamp voltage detected via the voltage terminal VL1 is integrated with the aid of the integrator circuit of the current detection block 100 shown in FIG. 4 and then the deviation from a predetermined desired value is evaluated. In particular, the measurement signal corresponding to the lamp voltage is integrated over a full period or multiple of a full period of the lamp voltage and then the deviation of the integration result from the original integration starting value is evaluated. For this purpose the integration starting value is supplied to the comparator 103 by application of the corresponding reference potential Vref5. With the aid of the switch S124 there can be set for the comparator 103, in the form of the further reference potentials Vref4 or Vref6, a positive limit value or a negative limit value for the rectifier effect recognition. The potential Vref5 may for example be 3.0V, whereas as positive reference potential Vref4 a value of 4.0V and as negative reference potential Vref6 a value of 2.0V can be employed.

With the aid of the evaluation circuit shown in FIG. 4 it is possible to recognise the rectification effect both in the positive and also in the negative direction. The output signal of the comparator shown in FIG. 4 is again supplied to the measurement phase controller 900 which after recognition of a rectifier effect issues a corresponding condition report or fault report to the process controller 800 shown in FIG. 3. Since, however, it should not be too hastily concluded that a rectifier effect is present, when this for example appears only for a short period, the measurement phase controller 900 carries out an event filtered processing of this fault report and ensures that there is sent to the process controller 800 a fault report of the rectifier effect only if the rectifier effect appears uninterrupted for a longer period of time. This applies in principle not only for the fault report indicating a rectifier effect but for all fault or condition reports issued by the measurement phase controller 900 to the process controller 800. The above-mentioned processing of the rectifier effect fault report is, however, in particularly sensible since in the case of the rectifier effect an insidious effect is involved which appears with a temporal delay. Therefore, the measurement phase controller 900 only sends out a rectifier effect fault report to the process controller 800 if a rectifier effect is detected by the comparator 103 shown in FIG. 4 32 times in succession each 255th period of the lamp voltage. As soon as no rectifier effect is detected during a period of the lamp voltage the counter of the measurement phase controller 900 allocated to the rectifier effect is again set to zero and the evaluation of the rectifier effect fault signal of the comparator 103 is begun anew.

As explained in more detail below, the appearance of a rectifier effect is taken into account only in the operational state of the electronic ballast since for example during the pre-heating phase the appearance of a rectifier effect should not lead to switch-off of the system.

In accordance with a preferred embodiment of the present invention the recognition of the rectifier effect is carried out in particular in that during the individual half-waves of the lamp voltage or of the parameter dependent thereupon, timing impulses of a (high frequency) reference clock are counted and compared with one another, whereby the counted timing pulses are dependent upon the temporal duration of the respective half-wave. If no rectifier effect is present the timing pulses counted during the positive and negative half-waves are in agreement. In the case of the presence of a rectifier effect the timing pulses counted during the positive and negative half-waves differ from one another.

Figure 11A:
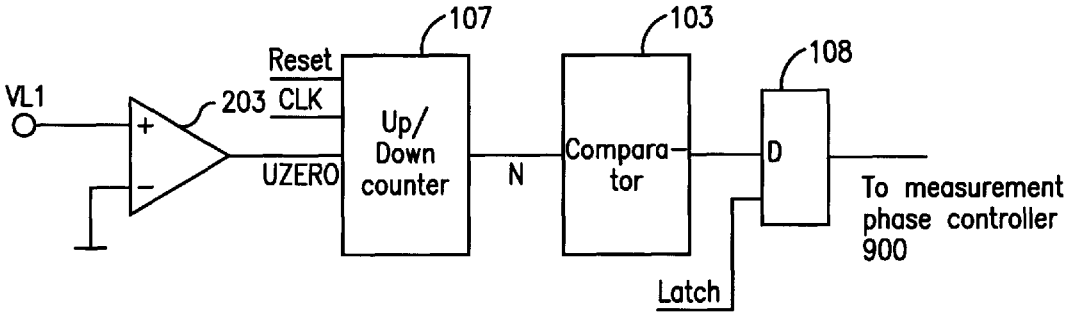
FIGS. 11*a* to 11*d* show illustrations for the purpose of explanation of a preferred exemplary embodiment of the present invention.

FIG. 11*a* shows a circuitry realisation of this exemplary embodiment with an up/down counter 107 which receives as actual input signal a signal UZERO and further receives as control signals a high frequency reference clock signal CLK, e.g. having the frequency 10 MHz, and a reset signal. The signal UZERO assumes during each positive half-wave of the lamp voltage applied to terminal VL1 a positive voltage level, and otherwise assumes a negative voltage level, and thus detects the zero crossing of the lamp voltage. The counter 107 is in particular formed as a 9-bit counter and upon application of the reset signal is initialised to a middle count state, e.g. to the initial count value $N_0$=255. The counter 107 is started upon zero crossing of the lamp voltage and during the following half-wave of the lamp voltage counts either downwardly or upwardly. When the measurement signal, i.e. the lamp voltage, again attains the zero crossing after a half-period, the counting direction of the counter 107 is reversed. After conclusion of a full period of the lamp voltage the current count value N of the counter 103 is connected to a comparator which may be formed for example by means of the above-described comparator 103. This comparator 103 compares the current count value N with the initialisation value or with the original count value of the counter 107. When no rectifier effect is present the count value N must, after attainment of the next zero crossing of the lamp voltage, have again attained the initial value $N_0$. If, however, the count value N deviates from the initial value $N_0$, a rectifier effect is present. Advantageously, the comparator 103 compares the count value N with the initial value $N_0$ within certain tolerance limits, in order thus not to conclude too hastily that a rectifier effect is present. The output signal of the comparator 103 is supplied via D-type flip-flop 108 of the measurement controller 900 which is clocked by means of a latch signal, which measurement phase controller—as has been described above—evaluates this signal and in particular carries out an event filtered evaluation, i.e. only determines that a rectifier effect is present if from the comparator 103 a rectifier effect is reported for example 32 times in succession each 255th period of the lamp voltage.

The zero crossing signal UZERO can for example originate from a further comparator 203 which monitors the voltage measurement signal applied to the voltage terminal VL1 with regard to its zero crossing. With the aid of this zero voltage comparator 203 the entire integrated measurement system of the controller circuit IC2 is cyclically synchronised with regard to the zero point of the lamp voltage. Thereby, the synchronisation is effected advantageously every second period of the output frequency. An exception from this principle is represented by the rectifier effect evaluation. In this case, the synchronisation is, because of the integration carried out for the rectifier effect evaluation, delayed beyond a full period of the lamp voltage by two further periods. The output signal of the zero crossing comparator 203 is likewise supplied to the measurement phase controller 900 and has central significance for the control of all controllable switches of the overall control circuit, the actuation of which is in each case controlled to the zero crossing of the lamp voltage.

Figure 11B:
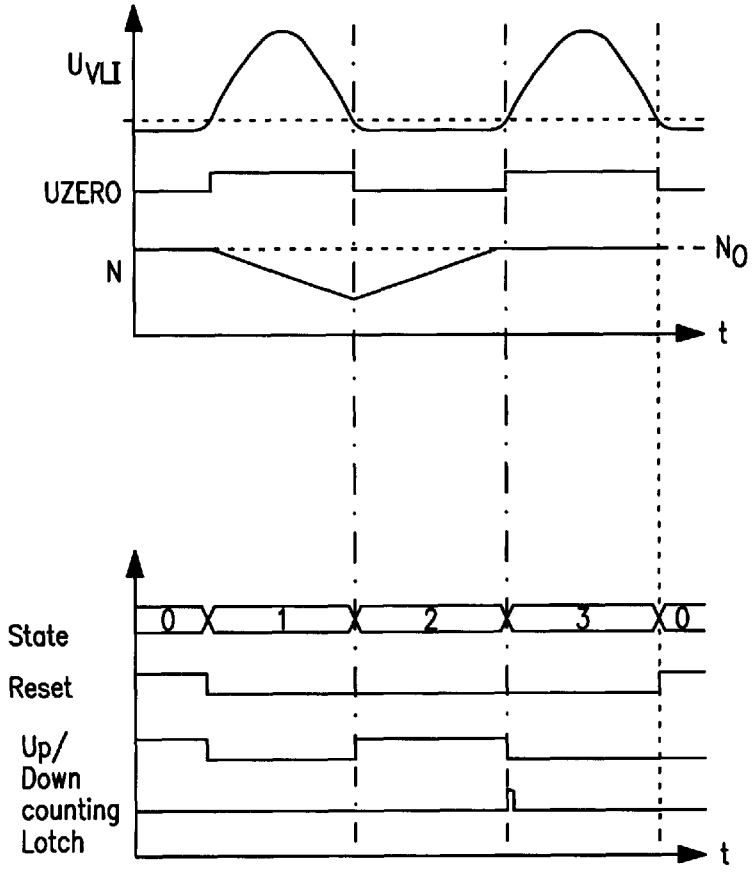

FIG. 11*b* shows an illustration of the signal developments in the circuit illustrated in FIG. 11*a* in the case that no rectifier effect is present, and the states thereby appearing. In particular it can be seen from FIG. 11*b* that the zero crossing signal UZERO assumes the positive level during the positive half-wave of the lamp voltage $U_{VL1}$ and, starting from the initialisation value $N_0$, the counter 107 reduces its count value N in accordance with the reference clock CLK until a new zero crossing of the lamp voltage $U_{VL1}$ is present. Then, the count value N is again increased. After one period of the lamp voltage $U_{VL1}$ the initial value of the comparator 103 is issued via the D-type flip-flop 108 to the measurement phase controller 900, by means of the latch signal, and then the counter 107 is again set to the initial value $N_0$ with the aid of the reset signal. In the case shown in FIG. 11*b*, the count value N of the counter 107 after a full period of the lamp voltage $U_{VL1}$ again corresponds to the initial value $N_0$, so that the comparator 103 does not report a rectifier effect.

Figure 11C:
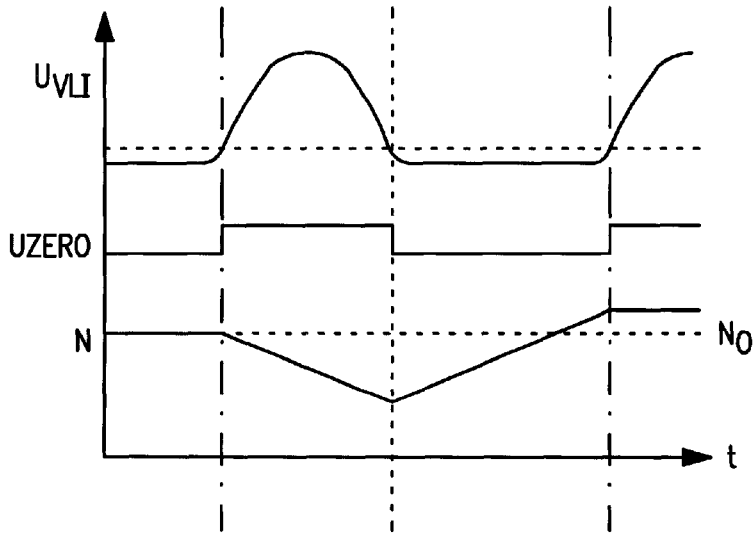
Figure 11D:
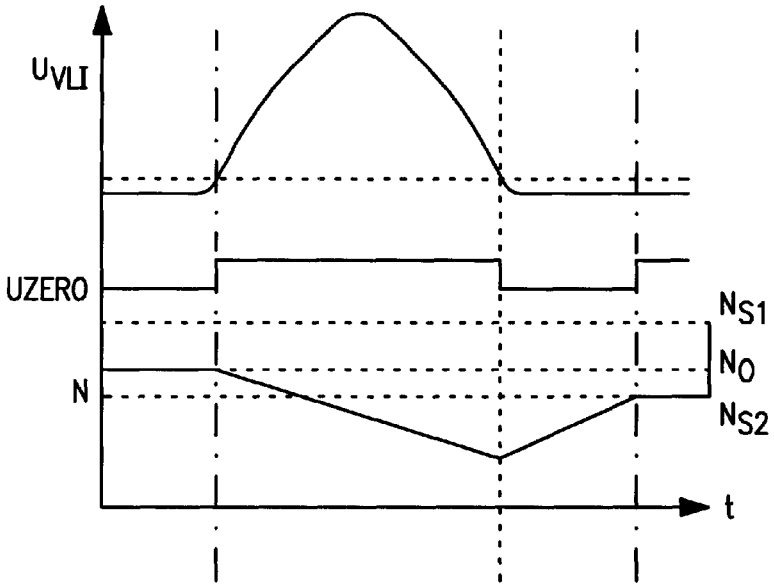

In contrast, FIGS. 11*c* and 11*d* show developments of the count value N in the case that a rectifier effect is present, whereby after expiry of a full period of the lamp voltage $U_{VL1}$ the count value N in accordance with FIG. 11*c* is greater than $N_0$ or, corresponding to FIG. 11*d* is smaller than $N_0$ and thus the comparator 103 recognises and reports the rectifier effect by mean of comparison of N with $N_0$.

As has already been explained above, the comparison of the comparator N is advantageously effected within predetermined tolerance limits, which are defined in accordance with FIG. 11*d* by means of threshold values $N_{S1}$ and $N_{S2}$, i.e. the comparator 103 only issues an output signal corresponding to the rectifier effect if the following condition is not fulfilled, $N_{S2}<=N<=N_{S1}$.

Advantageously, the threshold values are so non-symmetrically selected that the difference between $N_{S1}$ and $N_0$ is greater than the difference between $N_0$ and $N_{S2}$ (in particular is twice as great) since upon appearance of the rectifier effect shown in FIG. 11*d* the regulation behaviour of the electronic ballast constantly attempts to compensate for the current reduction consequent thereupon by means of frequency changing. In order to take account of this behaviour, the sensitivity of the rectifier effect recognition in the case of count value N which after a full period of the lamp voltage $U_{VL1}$ lies below the initial value $N_0$ is increased and the threshold value $N_{S2}$ is displaced towards the initial value $N_0$.

There may be connected to the voltage terminal VL1 a further function block for the recognition of over-voltage of the lamp voltage (c.f. the arrow illustrated in FIG. 6), whereby the output signal of this function block can also be delivered to the measurement phase controller 900 and for example again be event filtered (c.f. the above explained rectifier effect evaluation) to a corresponding fault report to the process controller 800.

The voltage detection block 200 shown in FIG. 6 includes a further function block which is provided for the recognition of a lamp exchange. This function block includes a sampling circuit 201, a switch S206 and a comparator 202. This lamp exchange recognition circuit makes possible the recognition of an exchange both of the upper gas discharge lamp G1 shown in FIG. 1 and also of the lower gas discharge lamp G2. Up to now, because of circuitry problems, it was possible and known only, by means of monitoring of the lower lamp coil of the lower gas discharge lamp G2, to monitor and to recognise an exchange of this lower gas discharge lamp G2. As soon as an exchange of the lower gas discharge lamp G2 was detected, a new start of the overall system was carried out. Since, however, an exchange of the upper gas discharge lamp G1 could not be recognised, the exchange of this upper gas discharge lamp G1 was without direct effect, i.e. no new start was effected. A technician could thus only with difficulty recognise which of the two gas discharge lamps G1, G2 shown in FIG. 1 was actually defective, since also after exchange of a faulty gas discharge lamp G1 no automatic new start was carried out, so that the technician received no indication as to whether the gas discharge lamp G1 which he had exchanged was actually defective.

With the aid of the present lamp exchange recognition circuit it is now possible to recognise the exchange of any gas discharge lamp G1, G2 connected to the electronic ballast. As soon as a lamp exchange is recognised, this is reported via the measurement phase controller 900 shown in FIG. 3 to the process controller 800 likewise schematically illustrated in FIG. 3, so that this process controller can automatically bring about a new start of the system after communication of a lamp exchange. A lamp exchange comes into consideration in particular when a lamp fault, such as e.g. a gas defect, is determined and reported by the control circuit. In this case, the technician will attempt to exchange the faulty lamp. Initially, however, the technician does not know which of the gas discharge lamps G1, G2 connected to the electronic ballast is faulty. Thus, he will exchange one of the connected gas discharge lamps. As soon as the lamp exchange recognition circuit of the voltage detection block 200 shown in FIG. 1 has recognised a lamp exchange, the process controller 800 shown in FIG. 3 will carry out a new start of the system. If a lamp fault is still recognised or ignition of all connected gas discharge lamps is not possible, the control circuit again goes into a fault or lamp exchange recognition condition, without the connected gas discharge lamps being able to be permanently driven. For the technician this means that the gas discharge lamp which he has exchanged was either not faulty or that a further faulty gas discharge lamp exists. In this case, the technician must exchange another gas discharge lamp connected to the electronic ballast. If, after a lamp exchange, a successful new start of the system is possible, this means for the technician that on the one hand the gas discharge lamp which he has exchanged was faulty and on the other hand that now all gas discharge lamps connected to the electronic ballast are fault-free. Overall, in this manner fault recognition and fault correction are considerably simplified for the technician, since the technician can decide immediately after exchange of a gas discharge lamp, on the basis of a successful or unsuccessful new start of the system, whether or not all lamps connected to the system are now fault-free.

With the aid of the lamp exchange recognition circuit illustrated in FIG. 6, a lamp exchange is recognised in that a supply voltage of particular frequency is applied to the load circuit from the inverter and with regard thereto the build up behaviour of the load circuit is evaluated. The assessment of the build up behaviour of the load circuit is in turn effected on the basis of the measurement signal applied to the voltage terminal VL1, proportional to the lamp voltage, whereby this measurement signal is sampled a plurality of times and thus the characteristic line of the lamp voltage arising as a consequence of the applied supply voltage is assessed.

The supply voltage applied to the load circuit in the lamp exchange recognition operation has in particular a relatively low frequency of for example 40 Hz. Further, in the lamp exchange recognition operation, only one of the two inverter switches T2, T3 (c.f. FIG. 1) is switched-on or switched-off alternately with the above-mentioned frequency, whereas the other inverter switch remains permanently open during the lamp exchange operation. In the present exemplary embodiment it is the upper inverter switch T2 which is permanently open, whereas the lower inverter switch T3 is alternately switched on and off with the low repetition frequency of about 40 Hz.

The function of the lamp exchange recognition circuit shown in FIG. 6 is as follows.

As has already been explained, in the case of recognition of a fault, the lower inverter switch T3 of the inverter D shown in FIG. 1 is switched on and off with a low repetition frequency of about 40 Hz, whereas the upper inverter switch T2 remains permanently switched off. As a result of the switching on and off of the inverter switch T3 there occurs in the load circuit of the electronic ballast a particular build up behaviour which in particular depends upon the gas discharge lamps connected to the electronic ballast. This build up behaviour of the load circuit is reflected in the measurement signal detected via the input terminal VL1, which is evaluated by the lamp exchange recognition circuit. For this purpose, the sampling circuit 201 stores at particular time points $T_1$–$T_3$ the momentary voltage value of the measurement signal applied to the terminal VL1. In principle, the third measurement at the time point $T_3$ is not absolutely necessary but it increases the reliability of the measurement with regard to disrupting influences. The above-described measurement procedure is effected after the opening of the inverter switch T3 and before its renewed closing.

After taking the measurement points at the time points $T_1$–$T_3$, the result is intermediately stored in the down-stream digital part (not shown in FIG. 6). Then, the lamp exchange recognition circuit is newly initialised, i.e. via the switch S206 a particular reference voltage Vref11 is switched in and a new sampling value of the voltage signal at terminal VL1 is intermediately stored in the sampling circuit 201. The comparator 202 thus carries out a double relative evaluation of the sampling values stored in the sampling circuit 201, i.e. there is determined on the one hand the difference between the sampling value stored the time point $T_1$ and the sampling value stored at the time point $T_2$ and on the other hand the difference between the sampling value taken at the time point $T_1$ and the sampling value stored at the time point $T_3$. This evaluation of the relative relationships between the individual sampling values is advantageous in comparison with the evaluation of absolute measurement parameters since there would be necessary for the evaluation of absolute measurement parameters additional components.

Figure 7A:
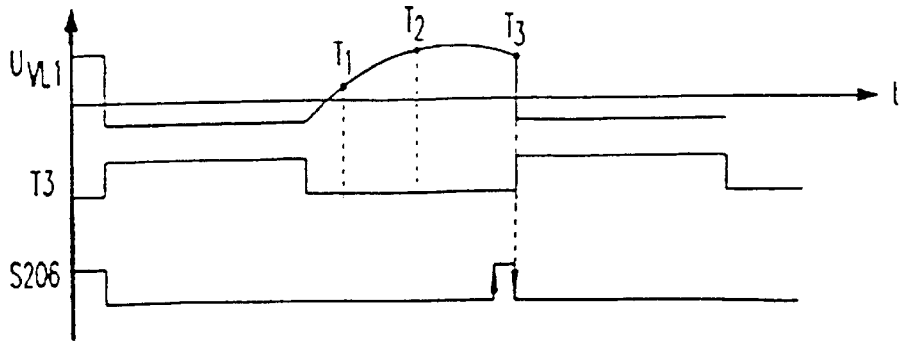
FIGS. 7*a* and 7*b* show illustrations for the purpose of explanation of the recognition of lamp exchange with the aid of the voltage detection block illustrated in FIGS. 3 and 6, FIGS. 8*a* and 8*b* show circuit diagrams of a warm/cold start changeover block illustrated in FIG. 3.

FIG. 7*a* shows a temporal diagram of the development of the voltage $U_{VL1}$ applied to the terminal VL1, the switching condition of the inverter switch T3 and the switching condition the switch S206 shown in FIG. 6. Further, there are indicated in FIG. 7*a* the individual sampling time points $T_1$, $T_2$ and $T_3$.

Figure 7B:
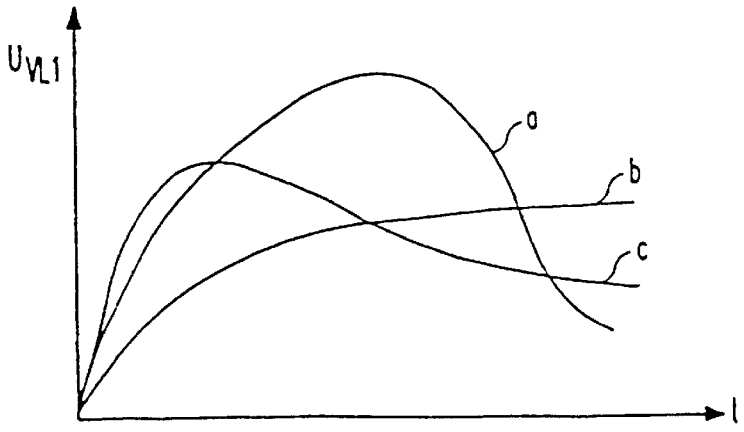

The evaluation of the comparator results between the sampling values at time points $T_1$ and $T_2$, and $T_1$ and $T_3$ delivered by the comparator 202 is effected in the measurement phase controller 900. On the basis of the build up process, i.e. on the basis of the voltage characteristic line formed by means of the sampling values at the time points $T_1$–$T_3$, it can be decided whether during the lamp exchange recognition operation one of the gas discharge lamps has been removed and, if yes, which of the gas discharge lamps was removed. Further it can determined whether instead all lamp coils of the individual gas discharge lamps are correctly connected with the load circuit, i.e. that all lamps are connected in a fault-free manner. FIG. 7*b* shows by way of example the development of the characteristic line of the voltage signal $U_{VL1}$ applied to the terminal VL1 for three different cases. The characteristic line a corresponds to that characteristic line which arises in the case of the exchange of the upper gas discharge lamp G1 shown in FIG. 1. The characteristic line b corresponds to the characteristic line in the case of the exchange of the lower gas discharge lamp G2 during the lamp exchange recognition operation. The third characteristic line c shown in FIG. 7*b* corresponds to the characteristic line in normal operation without lamp exchange, i.e. for the case that all lamps are connected. By means of the evaluation or detection of the characteristic line of the voltage signal $U_{VL1}$ applied to the terminal VL1, the control circuit can thus determine which of the connected gas discharge lamps G1, G2 has been exchanged. This means that there can reliably recognised not only an exchange of the lower gas discharge lamp G2 but also an exchange of the upper gas discharge lamp G1. As soon as the control circuit has recognised an exchange of one of the gas discharge lamps connected to the electronic ballast, an automatic new start of the system is carried out in order to ignite the connected gas discharge lamps.

In practice, the control circuit IC2 will, upon appearance of a lamp error in a fault condition monitor the build up behaviour with regard to the appearance of the characteristic line a or b. As soon as the voltage applied to the terminal VL1 develops in accordance with one of these characteristic lines, this means that one of the connected gas discharge lamps has been removed from its fitting for the purpose of fault correction. Then, the control circuit IC2 or the process controller 800 goes into the actual lamp exchange recognition condition, in which—as in the fault condition—only the lower inverter switch T3 is opened and closed for example at 40 Hz, whereas the upper inverter switch T2 is permanently open. In this condition the control circuit IC2 waits for the appearance of the characteristic line c, i.e. that in place of the removed lamp a replacement lamp has again being put in place and now all lamps are again connected. Then, the system carries out a new or restart. This procedure will again be explained later with reference to FIG. 9.

Figure 8A:
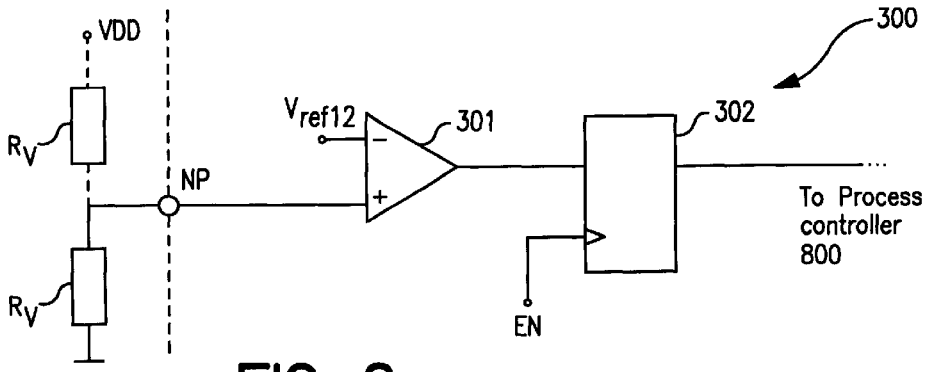
Figure 8B:
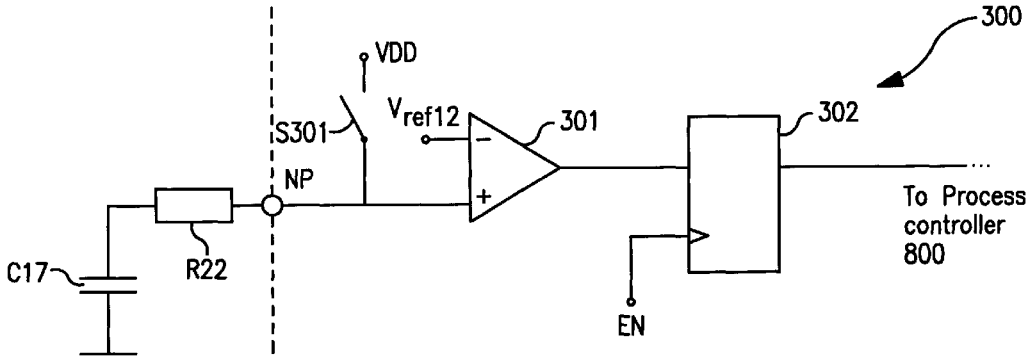
Figure 10:
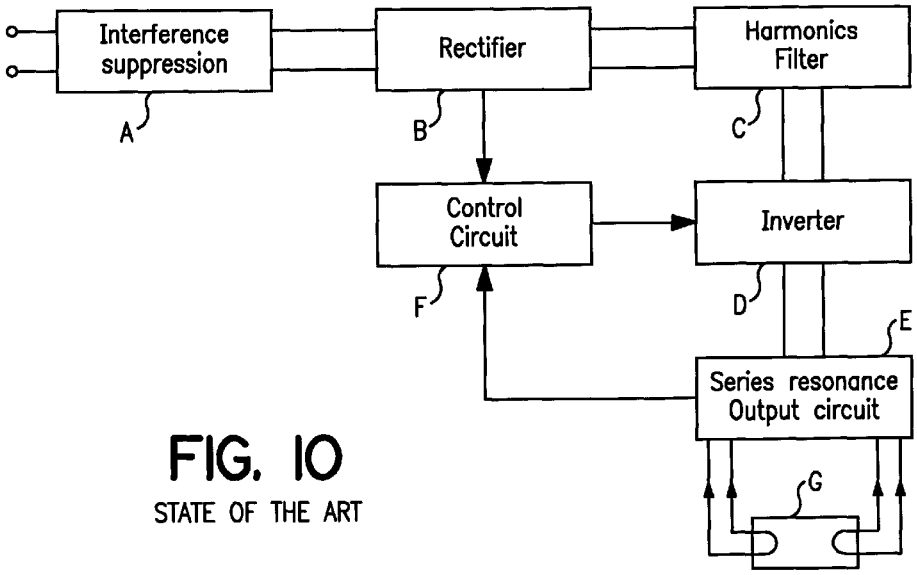
FIG. 10 shows a block circuit diagram of a known electronic ballast.

FIGS. 8*a* and 8*b* show two variants of the circuit 300 for the recognition of a warm/cold start operation illustrated in FIG. 3. It is common to both variants that the voltage potential applied to the terminal NP of the control circuit is continuously evaluated and it is determined by comparison with a predetermined reference voltage Vref12 whether a warm or a cold start should be carried out. This comparison is carried out with the aid of a comparator 301 the positive measurement input of which is connected with the terminal NP. On the output side, the comparator 301 is connected to a state retaining circuit 302 which may for example be realised by means of a D-type flip-flop. This state retaining circuit 302 brings about that the output signal of the comparator 301 is switched through to the process controller 800 and evaluated only when a corresponding release signal EN is present. This release signal EN assumes a high level for a short time exclusively upon the new or restart of the overall system, for example by means of actuation of a corresponding mains switch. At no later time point does a signal change at the terminal NP lead to a condition change at the output terminal of the state retaining circuit 302.

With the variant shown in FIG. 8*a*, switching between a cold start and a warm start operation can be effected by connection of a series resistance $R_V$ either to the higher supply voltage potential VDD or to the ground potential. If the series resistance $R_V$ is connected to VDD, a cold start operation is activated, i.e. the connected gas discharge lamps are ignited without pre-heating operation. On the other hand, if the series resistance $R_V$ is connected to the ground potential, a warm start operation is carried out, i.e. the connected gas discharge lamps are ignited with a preceding pre-heating operation for the pre-heating of the lamp electrodes. The comparator 301 can determine by monitoring the voltage potential at the terminal NP whether the resistance $R_V$ is connected to the supply voltage potential VDD or the ground potential. The evaluation of the comparator output signal is then effected in the process controller 800 shown in FIG. 3 which, in dependence upon whether a cold start or warm start operation is selected, controls the gas discharge lamp without or with pre-heating operating states.

FIG. 8*b* shows a variant of the above-explained circuit which makes possible a dynamic switching between a warm and a cold start operation. The circuit shown in FIG. 8*b* corresponds in substance to the circuit shown in FIG. 8*a*, however with the exception that internally a switch S301 is provided at the input terminal NP via which the supply voltage potential VDD can be applied to the input terminal NP, whereas externally an RC member—consisting of the resistance R22 and capacitor C17 already shown in FIG. 1 and 2—is connected to the terminal NP. As with the variant shown in FIG. 8*a*, the voltage potential applied to input terminal NP is monitored by the comparator 301. The function of the circuit shown in FIG. 8*b* is as follows.

During the normal operation of the electronic ballast, the switch S301 is closed so that the capacitor C17 is charged by the supply voltage potential VDD applied to the input terminal NP. If (e.g. as a consequence of a fault) switching off of the system or switching over of the system supply from mains to emergency current operation occurs, the switch S301 is opened and the capacitor C17 discharges with the time constant determined by the RC member. In accordance with standards, the RC member is advantageously so constituted that the capacitor C17 can retain the charge for so long that the voltage at the input terminal NP is greater then the reference voltage Vref12 applied to the comparator 301 for a duration of up to 400 ms.

Upon re-start or new start of the system, the release signal EN of the state retaining circuit 302 takes up a high level, so that the comparison result of the comparator 301 is through-connected. If at this time point the voltage potential applied to the input terminal NP is still greater than the reference voltage Vref12, the process controller 800 provides for the putting into operation of the connected gas discharge lamps without pre-heating operation and thus carries out a cold start. If, on the other hand, the voltage potential applied to the input terminal NP is smaller than the reference potential Vref12, the connected gas discharge lamps are pre-heated and thus a warm start is carried out.

From the above description it is apparent that the voltage potential applied to the input terminal NP of the control circuit is dependent upon the switch-on time of the switch S301, which is the same as the operating time of electronic ballast. This parameter is determinative for the charge condition of the capacitor C17. Further, the voltage potential at the input terminal NP is dependent upon the switch-off time of the switch S301 or upon the duration of the emergency current operation of the electronic ballast, and dependent upon the time constant of the RC member. These parameters are determinative for the discharging process of the capacitor C17.

The circuit shown in FIG. 8*b* thus carries out a cold start or a warm start in dependence upon the duration of the switch-off time and in dependence upon the time constant of the RC member. By means of corresponding dimensioning of the time constant of the RC member, that switch-off time duration can be determined which is just sufficient for a cold start operation of the connected lamps. For this purpose, the RC member must only be so dimensioned that after charging of the capacitor C17 and opening of the switch S301 the voltage potential applied to the input terminal NP is just greater than the reference potential Vref12 of the comparator 301 after expiry of the above-mentioned switch-off time duration. In accordance with the standard, however, the maximum allowed time between switching to emergency current operation and the new or re-start of the electronic ballast without pre-heating of the lamp electrodes, is determined to be 400 ms. In correspondence thereto, the resistance R22 and the capacitor C17 are to be so dimensioned that the above-mentioned time period of 400 ms can be complied with.

Of course, in place of the RC member having the resistance R22 and capacitor C17 shown in FIG. 8*b*, any other energy storage circuit can be employed which stores energy in dependence upon the supply voltage potential applied to the input terminal NP and which discharges with a particular time constant after disconnection of the supply voltage potential. This energy supply circuit can thus contain any kind of delay members, so long as a defined and known temporal behaviour of the delay member or of the energy storage circuit is provided.

Below, the function blocks 400 and 500 shown in FIG. 3 will be explained in more detail. The voltage regulator function block 400 generates an internally regulated, very precise supply voltage VDD for all internal function blocks, which at the same time is the source for all necessary reference voltages. As can be seen from FIGS. 1 and 2, this internal supply voltage VDD is taken out via the terminal VDD and filtered via the external capacitor C7 having good high frequency properties. Due to the availability of the internal supply voltage VDD there can be employed for all function parts of the overall electronic ballast a single low voltage level, which is advantageous particularly on grounds of costs.

The reference voltage generator 500 serves for the central generation of all reference parameters for the control circuit IC2, i.e. for the generation of all reference potentials and reference currants.

The oscillator 600 illustrated in FIG. 3 represents the central timing source for the entire control circuit IC2. The oscillator 600 is so constructed that no external components are necessary. The basic timing of the oscillator is balanced with the aid of micro-fuses to the desired value of for example 10 MHz, with an exactitude of e.g. 4 bits. Via a digital input of the oscillator 600, the frequency of the timing generator can be reduced to about 1/20 of the nominal timing rate, i.e. to about 550 kHz. This reduced timing rate is necessary, as will be explained in more detail below, for particular operating states, in particular for the fault and lamp exchange recognition states, in which the supply energy must be reduced. The timebase generator 700 likewise shown in FIG. 3, generates a plurality of constant time intervals, in dependence upon the basic timing of the oscillator 600, which are delivered via digital outputs of timebase generator 700 to the individual function blocks of the control circuit IC2. The process control function block 800 receives, for example, all temporal reference parameters from the timebase generator 700. All temporal parameters generated by the timebase generator 17 are a multiple of the basic timing of the oscillator 600. The temporal reference parameters generated by the timebase generator 700 may for example include the individual pre-heating times or the ignition time. These temporal reference parameters are, as will be explained in more detail below, of significance in particular for the temporal operating state control of the control circuit IC2, which is carried out by the process control function block 800.

The function of the process controller 800 will be explained in more detail below with reference to FIG. 9.

Figure 9:
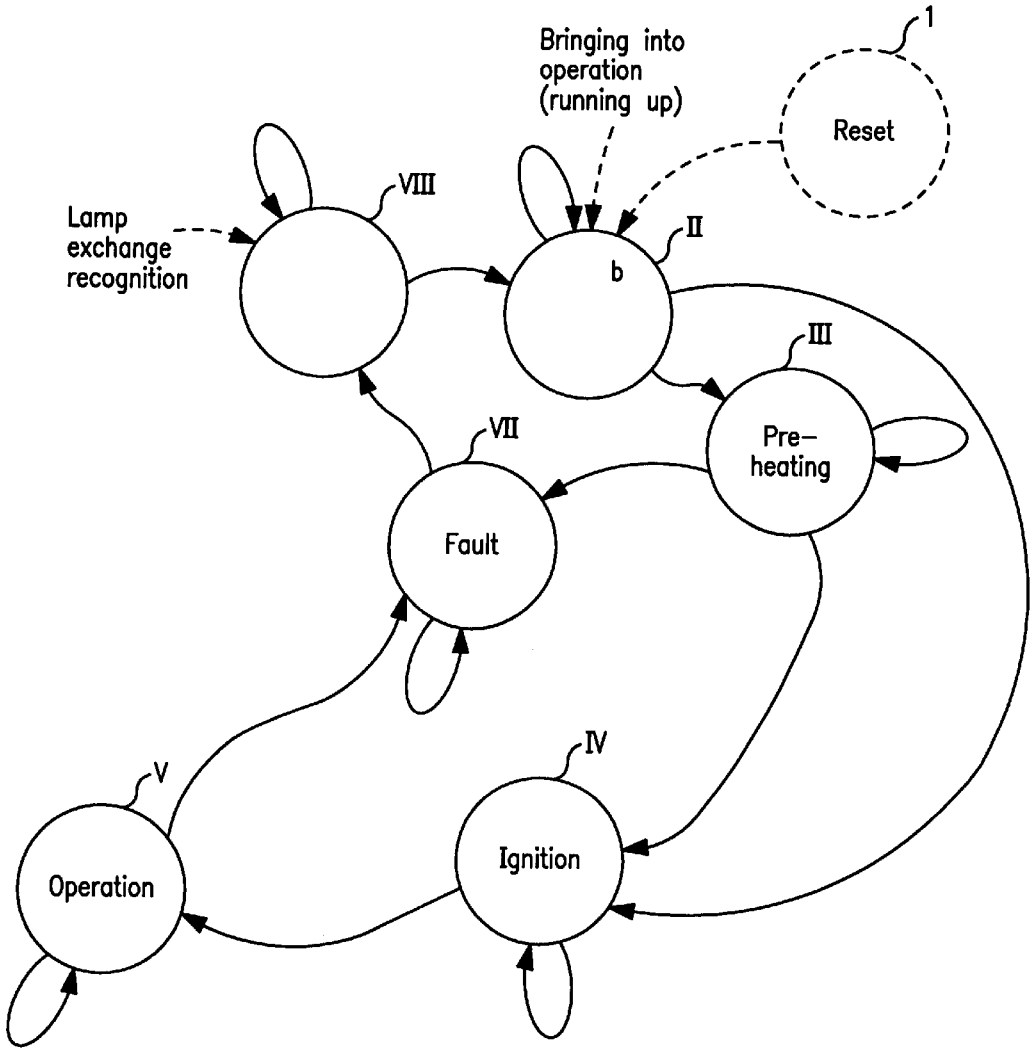
FIG. 9 shows by way of example various operating states controlled by the electronic ballast illustrated in FIG. 1.

The process control function block 800 controls the operation of the electronic ballast for example in accordance with the state diagram illustrated in FIG. 9. Thereby, in FIG. 9, each possible operating state is schematically represented by a circle, whereas the individual arrows represent possible state changes which appear upon fulfilment of an associated condition corresponding to the two operating states. These conditions are each linked to particular states of particular state parameters or monitoring parameters of the electronic ballast or of the lamp(s), whereby these monitoring parameters are processed internally by the process controller 800 in the form of variables which, in dependence upon whether the monitoring parameter takes up the corresponding state or not, for example take on the value "1" upon taking up the associated state or "0" when the state is not taken up. The individual parameters monitored by the process controller 800 may include for example temporally based parameters or fault parameters. With regard to the temporally based parameters there can be monitored for example the expiry of a time for bringing into operation, a pre-heating time, an ignition time or a delay time for the rectifier effect recognition. With regard to the fault parameters there may be monitored for example the appearance of a capacitive current in the load circuit (via the current detection block 100), the presence of an over-voltage at the connected gas discharge lamp, the appearance of a rectifier effect or of an non-symmetric lamp operation, the non-presence of a lamp or the appearance of a synchronisation fault with regard to the zero crossing of the lamp voltage (in each case via the voltage detection block 200). Further, the output signal of the function block 300 can be monitored with the aid of which a decision between a warm start operation and a cold start operation can be made. Of course, any other monitoring parameters of the electronic ballast are conceivable.

As has already been described, although the individual fault parameters are detected by the blocks 100–300 shown in FIG. 3, there is initially effected however a processing by means of the measurement phase control function block 900 before the individual failure parameters are actually evaluated by the process controller 800. For this purpose, the measurement phase controller contains for each monitored fault parameter a digital event filter associated with the corresponding fault parameter. This digital event filter carries out in principle the function of a counter which counts the uninterrupted appearance of the corresponding fault. A fault report is given out from the corresponding event filter to the process controller 800 only then when the corresponding fault has appeared n-times in succession, whereby n corresponds to the filter depth of the corresponding digital event filter and may be different for each fault parameter. As soon as the fault no longer appears upon a read out, the count value of the digital event filter is reset and the counting procedure begun again from the beginning. In this way it is ensured that the process controller 800 does not react over hastily to the appearance of a particular fault, and an operating state change as a consequence of a particular fault report is only the carried out when it can be assumed with relatively great reliably that the corresponding fault is actually present.

In this respect, the digital event filter for the rectifier effect recognition represents a special case, since in the case of the rectifier effect an insidious, i.e. temporally slowly appearing, fault case is involved. Thus, the event filter associated with the rectifier effect is so dimensioned that the appearance of a rectifier effect is determined upon, and the corresponding fault report issued to the process controller 800, only in the case a rectifier effect is reported to the measurement phase controller 900 32 times in succession each 255th period of the lamp voltage. Correspondingly, the event filter associated with the rectifier effect includes a filter depth of $n=32\times225$. In contrast, there may be provided for the detection of a capacitive current a filter depth of 64, for the detection of an overvoltage a filter depth of 3 and for detection of a synchronisation fault and for the lamp exchange recognition in each case a filter depth of 7. Of course, other filter depth values are conceivable.

In the following, when the appearance of a particular fault case is mentioned, there is meant the corresponding fault report from the measurement phase controller 900 to the process controller 800 after passing the correspondingly associated event filter.

The initial state of the operational state control shown in FIG. 9 is the so-called reset state (state I). The system is always in state I when the electronic ballast is started or started anew, which is the same as the appearance of the release signal EN explained with reference to FIG. 8. For this purpose, the process controller 800 may include a comparator with hysteresis characteristics, which monitors the external supply voltage signal VCC within particular limits and generates the release signal EN in the case that the supply voltage signal VC lies within the necessary supply voltage range. In this way, the comparator monitors both the switching-on and switching-off of the overall system. The release signal EN can thus appear, in dependence upon the switching on and switching off of the overall system, asynchronously to all other signals, whereby after the appearance of the release signal EN, i.e. after switching on or re-switching on of the electronic ballast, the adjustment of the individual functional blocks of the control circuit IC2 is effected. This adjustment is effected by means of reading in of the respective values for the individual micro-fuses. These micro-fuses are small fuses which serve for example for the adjustment of the individual internal current sources. Further, as has been explained with reference to FIG. 8, with appearance of the release signal EN there is effected the reading in of the output signal of the function block 300 shown in FIG. 3, so that at this time point it is determined whether the connected gas discharge lamps should be taken into operation with a cold start or a warm start. Overall, there is thus effected in state I an initialisation of the control circuit IC2.

After initialisation of the control circuit, the process controller 800 goes automatically into a bringing into operation state (state II). The transition from state I to state II is, exceptionally, not linked to particular conditions and takes place automatically with each new or restart of the electronic ballast. In state II, there takes place the running up of the harmonic filter and the build up of the load circuit of the electronic ballast. Further, in state II, the coupling capacitor of the load circuit is precharged. In this phase, all fault detectors are deactivated, i.e. there is effected no evaluation of the above-mentioned fault parameters.

A pre-heating state III is entered starting from the state II, in the case that e.g. a bringing into operation time associated with state II, which designates the normal operational duration of state II, has expired and no cold start operation is reported by the function block 300 shown in FIG. 3. On the other hand, if the bringing into operation time has not yet expired, the system further remains in state II, which is illustrated in FIG. 9 by means of an arrow starting from state II and again returning to the state II. If a cold start operation is detected by the function block 300, and if the bringing into operation time is already expired, the process controller 800 changes directly from state II into an ignition state IV, which corresponds to the above-explained warm start operation.

In the first pre-heating state III, the inverter half-bridge is so controlled that it oscillates in terms of frequency at the upper limit and for example generates an output frequency of about 80 kHz. In this condition, the pre-heating regulation, the over-voltage recognition and the capacitive current recognition may be activated.

After expiry of a predetermined pre-heating time, a transition into the above-mentioned ignition state IV takes place if no lamp over-voltage and no capacitive current operation has been detected. During the ignition state IV, all fault detectors of the control circuit are deactivated with the associated event filters of the measurement phase control function block. Correspondingly, starting from this state IV, there can be no jump into a fault state VII which is explained in more detail below. This means that the system remains in ignition state IV until the state change condition for the transition into an operational state V is fulfilled.

In the ignition state IV, the working frequency of the inverter of the electronic ballast can be changed in dependence upon the value of the detected lamp current and the states of the over-voltage and capacitive current recognition. Starting from the working point of the load circuit predetermined by means of the pre-heating operation, it is attempted with the aid of the regulation parameter "lamp current" initially to reduce the output frequency of the inverter since the detected lamp current—due to the not yet effected ignition—is significantly too little with regard to the predetermined desired value. This regulation procedure is continued for so long until the over-voltage recognition or capacitive current recognition prevent or counter the continuing reduction of the inverter frequency. As a rule, initially the over-voltage recognition will be the dominant influencing factor. As a consequence of the now present dominance of the over-voltage recognition, the lamp voltage is now also regulated. Nothing changes in this behaviour until the ignition of the lamp or until the expiry of the predetermined ignition time. As a rule, however, the gas discharge lamp will ignite before expiry of the predetermined ignition time, whereby in this case the lamp-current regulation will again be dominant and the output frequency of the inverter will be reduced for so long until the stable working point determined by means of the lamp current reference value is taken up. In the ignition state IV, the capacitive current recognition will only actively interfere in the ignition procedure in the case of a fault, e.g. upon saturation of the resonance circuit choke L3 shown in FIG. 1. As soon as the capacitive current recognition responds, the output frequency of the inverter is displaced upwardly by means of the control circuit for so long until another of the above-mentioned influencing parameters during the ignition operation IV again becomes dominant. Additionally, at this point attention is directed to the fact that during the ignition state IV there is carried out a new desired value/actual value comparison by the regulation circuit of the control circuit IC2 only for example in each eighth period of the output frequency of the inverter, since it as proved in practice that with the aid of a thus reduced regulation timing for example the lamp voltage can be regulated with a significantly lesser ripple.

The ignition state IV can be exited, in the direction of the already above-mentioned operational state V, only after expiry of the predetermined ignition time. This state change is in particular independent of whether in ignition state IV regulation is still being effected with reference to the ignition voltage or already with reference to the lamp current.

After attainment of the operating state V shown in FIG. 9, regulation is effected with regard to the average or effective value of the lamp current, as has already been explained, i.e. the output frequency of the inverter is dependent upon the detected lamp current. During this operating state V, the over-voltage, capacitive current and synchronisation fault recognition are activated, whereby also during this state the regulation circuit carries out a new desired value/actual value comparison only in each second period of the inverter output frequency. Likewise, the rectifier effect recognition (GLRE) may be activated. The operating state V is not temporally limited, i.e. it represents in principle an endless loop, and can be exited only upon the response of one of the activated fault detectors. Advantageously, during the operational state V, all fault detectors of the control circuit are activated.

Now, if a fault appears in one of the above-explained states III or V, which is detected by means of the corresponding state dependently activated fault detector, the fault state VII illustrated in FIG. 5 is entered. This fault state VII is thus the central reference point for all serious operational disruptions. The fault state VII is directly jumped to starting from the pre-heating state II if during this pre-heating state an over-voltage the fault state VII is entered from operating state V if there is detected during this state a capacitive current operation, an over-voltage fault, a synchronisation fault and/or the appearance of the rectifier effect etc. with regard to the connected gas discharge lamps.

The entry into the fault state VII may be linked for example at the same time with a corresponding signalling of the respective fault for the user. The fault state VII is only exited by the process controller if, after a new start of the system, the gas discharge lamps are newly put into operation via the reset state I and the bringing into operation state II. Alternatively, the fault state VII can be exited if in this state it is detected that not all of the lamps connected to the electronic ballast have intact lamp coils. This is the same as the fault state VII being exited in the direction of the already above-explained lamp exchange recognition state VIII, as soon as one of the connected gas discharge lamps is taken out of its fitting. Additionally, attention is drawn to the fact that during the fault state VII the operating current take up of the control circuit is reduced to a minimum possible value.

In the fault state, the electronic ballast is operated as in the lamp exchange recognition state, i.e. in each case the lower inverter switch T3 is opened and closed with a low frequency of for example 40 Hz whilst the upper inverter switch is permanently open. As has already been explained with reference to FIGS. 6/7, in fault state VII, the control circuit IC2 waits for the appearance of the voltage characteristic line a or b (c.f. FIG. 7*a*) at the voltage measurement terminal VL1 which corresponds to the removal of one of the connected gas discharge lamps G1, G2. In this case, the control circuit IC2 goes into the lamp exchange recognition state VIII.

With the aid of the lamp exchange recognition process already explained above, the control circuit can reliably determine both an exchange or a removal of the upper gas discharge lamp G1 and also of the lower gas discharge lamp G2 (c.f. FIG. 1) and after recognition of a lamp change can automatically bring about a new start of the system. Whereas in fault condition VII it is checked whether a gas discharge lamp has been removed, in lamp exchange recognition condition VIII it is monitored whether all gas discharge lamps are in place. As soon as it recognised that all gas discharge lamps have been put in place, i.e. that all lamp coils connected to the electronic ballast are intact, automatic switch over to the bringing into operation state II occurs and the gas discharge lamps are again taken into operation in accordance with the functional cycle illustrated in FIG. 9. Also during the lamp exchange recognition state VIII, with the exception of the lamp exchange recognition, all other fault detectors are deactivated.

Finally, there will be explained briefly below the function of the inverter controller 1000 shown in FIG. 3.

The inverter control function block 1000 serves for the generation of control signals for the upper and lower inverter switches T2, T3 (c.f. FIG. 1) which are issued via the output terminals OUTH and OUTL of the control circuit. In dependence upon these control signals, the two inverter switches are either switched on or opened. As a rule, the inverter controller 1000 generates alternate control pulses for the control terminals OUTH and OUTL of the two inverter switches T2 and T3 and may also have an internal dead time counter function in order to ensure a sufficient dead time between the control of the two inverter switches. In the lamp exchange recognition condition VIII (c.f. FIG. 9) the inverter controller 1000 ensures that via the upper output terminal OUTH the upper inverter switch T2 remains permanently open whereas only the lower inverter switch T3 is alternately opened and closed with a relatively low frequency via the lower output terminal OUTL.

The inverter controller 1000 provides in particular for a non-symmetric duty ratio of the inverter switches, whereby however this non-symmetry amounts at an output frequency of the inverter of for example 43 kHz to only 2.1% and at an output frequency of 80 kHz to only 4%, and thus is hardly of significance. The generation of non-symmetric output signals for the two inverter switches leads to an increase of the frequency resolution of inverter, i.e. with the aid of the control circuit smaller frequency steps of the inverter can be set.

The generation of a non-symmetric duty ratio has, however, also the effect that the so-called "wavering" of the connected gas discharge lamps can be altered. This wavering involves an effect, which appears in particular at low temperatures shortly after the start of the system, of "running layers" which are caused by an uneven light distribution in the corresponding gas discharge lamp. These "running layers" consist of light/dark zones which run with a particular speed along the lamp tube. As is for example known from EP-B1-0 490 329, this running effect can be so accelerated by the superposition of a slight d.c. current that it no longer has a disturbing effect. Also the generation of a non-symmetric duty ratio by means of the present control circuit of the electronic ballast can work against the appearance of the so-called "wavering".

As has already been explained above, with the aid of the present control circuit there is generated during individual half-periods a non-symmetric duty ratio for the two inverter switches, whereby however the duty ratio is averaged out over a complete period. Since non-symmetric output signals are to be generated only in the operating state V shown in FIG. 9, the inverter controller 1000 for example evaluates a corresponding control signal which only then allows (e.g. by taking up a higher level) the non-symmetrical operation if the system is in the operating state V.

What is claimed is:

1. Process for the recognition of the rectifier effect appearing in a gas discharge lamp, said process comprising the steps of:

detecting and integrating a lamp voltage applied to a gas discharge lamp to be monitored, or a parameter dependent on said lamp voltage;

integrating said detected voltage over a full period or over a multiple of a full period of the detected voltage; and determining the presence of a rectifier effect if a rectifier effect condition as determined by said voltage integration deviates from a particular desired value, the presence of a rectifier effect being determined upon only if the rectifier effect condition is repeatedly fulfilled in successive regular time intervals.

2. Process according to claim 1, wherein the step of determining the presence of a rectifier effect is performed if the integration result exceeds a predetermined upper limit value or falls below a predetermined lower limit value.

3. Process according to claim 2, including the step of using a monitoring circuit, configured as an integrating circuit, to monitor and integrate the detected voltage parameter, and for the processing of the detected voltage, raising it into the working voltage range of the monitoring circuit.

4. Process according to claim 1, wherein said step of determining the presence of a rectifier effect is carried out only if a rectifier effect condition appears without interruption n1-times successively in each n2-th period of the detected lamp voltage.

5. Process according to claim 4, wherein n1=32 and n2=255.

6. Process according to claim 1, further including the step of:

controlling the gas discharge lamp by means of an electronic ballast, and wherein the rectifier effect condition, the lamp voltage or a parameter dependent on the lamp voltage is not evaluated during a pre-heating phase for the preheating of the lamp coils of the gas discharge lamp or during an ignition phase for the ignition of the gas discharge lamp.

7. Process for the recognition of the rectifier effect appearing in a gas discharge lamp, said process comprising the steps of:

detecting a lamp voltage applied to a gas discharge lamp to be monitored, or a parameter dependent on said lamp voltage; and determining the presence of a rectifier effect if, as a rectifier effect condition, the difference between the temporal duration of a positive half-wave and the temporal duration of a negative half-wave of the detected lamp voltage or the detected parameter exceeds a particular threshold value.

8. Process according to claim 7, further including the step of:

measuring the duration of the positive or negative half-wave of the detected parameter by counting between zero crossings of the detected parameter, and wherein said step of determining the presence of a rectifier effect is carried out if the difference between reference timing pulses of the positive half-wave and reference timing pulses of the negative half-wave of the detected parameter exceed said particular threshold value.

9. Process according to claim 8, wherein said step of determining includes conducting a comparison between the reference timing pulses of the positive half-wave and of the negative half-wave of the detected parameter by use of a counter which, starting from a particular initial count value, counts in one particular direction during one half-wave of the detected parameter and during the following half-wave of the detected parameter counts in an opposite direction, and wherein the presence of a rectifier effect is determined if the difference between the count value of the counter, after a period of the detected parameter and the initial count value of the counter exceeds the particular threshold value.

10. Process according to claim 9, wherein the step of determining the presence of a rectifier effect is carried out to determine such effect where a difference between the count value of the counter, after a period of the detected parameter, and the initial count value of the counter, is greater than a particular upper threshold value or is less than a particular lower threshold value, and wherein a difference between the upper threshold value and the initial count value is selected to be greater than the difference between the initial count value and the lower threshold value.

11. Process according to claim 7, wherein said step of determining the presence of a rectifier effect determines such presence only if the rectifier effect condition is repeatedly fulfilled in successive regular slots.

12. Process according to claim 11, wherein said step of determining the presence of a rectifier effect determines such presence only if the rectifier effect condition appears without interruption n1-times successively in each n2-th period of the detected parameter.

13. Process according to claim 12, wherein n1=32 and n2=255.

14. Process according to claim 7, further including the step of controlling the gas discharge lamp via an electronic ballast, and further including the step of limiting the determination of a rectifier effect such that during a pre-heating phase for the preheating of the lamp coils of the gas discharge lamp, or during an ignition phase for the ignition of the gas discharge lamp, the rectifier effect condition or the lamp voltage or the parameter dependent thereon is not evaluated.

15. In combination:

an electronic ballast for the operation of at least one gas discharge lamp from an a.c. voltage source;

a load circuit connected to the a.c. voltage source; and a rectifier effect recognition means which detects and integrates a parameter of the load circuit which corresponds to the lamp voltage of the gas discharge lamp or is dependent thereon, the rectifier effect recognition means being constructed and arranged to integrate the detected parameter over a full period or a multiple of this full period of this parameter, and to determine upon the presence of a rectifier effect in the gas discharge lamp if, as rectifier effect condition, the integration result deviates from a particular value, said rectifier effect recognition means also being constructed and arranged to determine the presence of the rectifier effect only if the rectifier effect condition is fulfilled a plurality of times in succession.

16. Electronic ballast according to claim 15, wherein the rectifier effect recognition means includes integration means which integrate the detected parameter, and wherein the rectifier effect recognition means includes comparator means to which there is supplied on the one hand the output signal of the integration means and on the other hand an upper or lower limit value, whereby the upper and lower limit value define a predetermined desired value range for the integration result.

17. Electronic ballast according to claim 15, wherein the rectifier effect recognition means is formed as application specific integrated circuit and includes signal raising means which raises the signal of the detected parameter into the working voltage range of the application specific integrated circuit.

18. Electronic ballast according to claim 16 or claim 17, wherein the integration means is balanced to that voltage value by which the signal of the detected parameter is raised with the aid of the signal raising means.

19. Electronic ballast according to claim 15, wherein the rectifier effect recognition means includes means for the detection of the zero crossing of the detected parameter.

20. Electronic ballast according to claim 15, wherein the rectifier effect recognition means is constructed, and connected to control the operation of the gas discharge lamp in dependence upon its operating state, wherein:

the rectifier effect recognition means controls, in a pre-heating state, the pre-heating of the lamp coils of the gas discharge lamp and, in an ignition state, the ignition of the gas discharge lamp, and after successful ignition, brings the gas discharge lamp into an operational state, and wherein the rectifier effect recognition means evaluates the rectifier effect condition or the detected parameter only in said operational state.

21. Electronic ballast according to claim 19, wherein the rectifier effect recognition means is constructed to change to a fault state after recognition of the rectifier effect of a gas discharge lamp connected to the electronic ballast, which change the rectifier effect recognition means undergoes only if the gas discharge lamp connected to the electronic ballast is exchanged or the electronic ballast is newly started.

22. Electronic ballast according to claim 21, wherein the rectifier effect recognition means includes lamp exchange recognition means constructed and arranged to detect an exchange of a gas discharge lamp connected to the electronic ballast.

23. Electronic ballast according to claim 21, wherein the rectifier effect recognition means includes filter means arranged to receive an output signal of the comparator means and to generate an output signal indicating the appearance of the rectifier effect only if the comparator means indicates fulfilment of the rectifier condition a plurality of times in succession.

24. Electronic ballast for the operation of at least one gas discharge lamp from an a.c. voltage source, said electronic ballast comprising:

a load, circuit, which includes at least said one gas discharge lamp connected to the a.c. voltage source; and rectifier effect recognition means connected to detect a parameter of the load circuit which corresponds to the lamp voltage of the gas discharge lamp or is dependent thereon, said rectifier effect recognition means being constructed and arranged to compare the temporal duration of a positive half-wave of the detected parameter with the temporal duration of the negative half-wave and to determine, upon the presence of the rectifier effect in the gas discharge lamp if the difference between the temporal duration of a positive half-wave and the temporal duration of a negative half-wave of the detected parameter exceeds a particular threshold value.

25. Electronic ballast according to claim 24, wherein the rectifier effect recognition means includes a counter which, starting from an initial count value, changes its count value in a particular direction during a half-wave of the detected parameter in accordance with a reference timing signal and in the subsequent half-wave changes its count value in accordance with the reference timing signal in the opposite direction, and wherein the rectifier effect recognition means further includes comparator means which is constructed and arranged to compare the count value of the counter after a period of the detected parameter, with an initial count value and to generate an output signal indicating the rectifier effect if the difference between the count value of the counter after expiry of the period of the detected parameter and the initial count value exceeds a particular threshold value.

26. Electronic ballast according to claim 25, wherein the comparator means is constructed and arranged to generate the output signal indicating the rectifier effect if the difference between the count value of the counter after expiry of the period of the detected parameter and the initial count value is greater than a particular upper threshold value or is less than a particular lower threshold value, the difference between the upper threshold value and the initial count value being selected to be greater than the difference between the initial count value and the lower threshold value.

27. Electronic ballast according to claim 24, wherein the rectifier effect recognition means is constructed and arranged to determine the presence of the rectifier effect only if the rectifier effect condition is fulfilled a plurality of times in succession.

28. Electronic ballast according to claim 24, wherein the rectifier effect recognition means includes means for the detection of a zero crossing of the detected parameter.

29. Electronic ballast according to claim 24, wherein the rectifier effect recognition means is constructed and arranged to control the operation of the gas discharge lamp in dependence upon the gas discharge lamp operating state, wherein the rectifier effect recognition means is constructed and arranged to control, in a pre-heating state, the pre-heating of control lamp coils of the gas discharge lamp and, in an ignition state, the ignition of the gas discharge lamp, and after successful ignition, changes the gas discharge lamp to an operational state, and wherein the rectifier effect recognition means is constructed and arranged to evaluate the rectifier effect condition or the detected parameter only in the operational state.

30. Electronic ballast according to claim 29, wherein the rectifier effect recognition means is constructed to change into a fault state after recognition of the rectifier effect of a discharge lamp connected to the electronic ballast, which the rectifier effect recognition means changes only if the gas discharge lamp connected to the electronic ballast is exchanged or the electronic ballast is newly started.

31. Electronic ballast according to claim 30, wherein the rectifier effect recognition means includes lamp exchange recognition means constructed and arranged to detect exchange of a gas discharge lamp connected to the electronic ballast.

32. Electronic ballast according to claim 25, wherein the rectifier effect recognition means includes filter means connected to receive an output signal of the comparator means and to generate an output signal indicating the appearance of the rectifier effect only if the comparator means indicates fulfilment of the rectifier condition a plurality of times in succession.

* * * * *